US006427839B1

(12) United States Patent
Helfer-Grand

(10) Patent No.: US 6,427,839 B1
(45) Date of Patent: Aug. 6, 2002

(54) HANDS-FREE PORTABLE TOWELETTE DISPENSER APPARATUS

(76) Inventor: Beverly Helfer-Grand, 4 Lake Rd., Huntington Station, NY (US) 11746

( * ) Notice: Subject to any disclaimer, the term of this patent is extended or adjusted under 35 U.S.C. 154(b) by 0 days.

(21) Appl. No.: 09/551,182

(22) Filed: Apr. 17, 2000

Related U.S. Application Data

(60) Provisional application No. 60/130,371, filed on Apr. 21, 1999.

(51) Int. Cl.[7] ..... B65D 73/00

(52) U.S. Cl. ..... 206/494; 206/205; 206/233; 206/812; 383/38; 150/112

(58) Field of Search ..... 206/233, 449, 206/494, 812, 205, 581, 438; 383/41, 42, 81, 38, 84, 86; 53/449, 467, 468; 224/901, 901.2, 901.4; 150/112, 117, 118

(56) References Cited

U.S. PATENT DOCUMENTS

| | | | | | |
|---|---|---|---|---|---|
| 2,166,360 | A | | 7/1939 | Lewis | |
| 2,415,588 | A | | 2/1947 | Gui | |
| 4,610,357 | A | * | 9/1986 | Nakamura | 206/494 |
| 4,739,809 | A | | 4/1988 | Adams | |
| 4,739,879 | A | * | 4/1988 | Nakamura | 206/812 |
| 5,111,934 | A | * | 5/1992 | Morin | 206/812 |
| 5,169,043 | A | | 12/1992 | Catania | |
| 5,409,116 | A | * | 4/1995 | Aronsen | 206/494 |
| 5,447,227 | A | | 9/1995 | Koseberg | |
| 5,688,394 | A | * | 11/1997 | McBride, Jr. et al. | 206/812 |
| 5,782,280 | A | | 7/1998 | Berry | |
| 5,803,249 | A | | 9/1998 | Harsanyi et al. | |
| 5,871,132 | A | | 2/1999 | Hargreaves | |
| 5,899,371 | A | | 5/1999 | Weliver | |
| 5,941,438 | A | | 8/1999 | Price | |
| 6,047,752 | A | | 4/2000 | Southwick | |
| 6,065,591 | A | * | 5/2000 | Dill et al. | 206/494 |
| 6,109,496 | A | | 8/2000 | Andrew et al. | |
| 6,213,424 | B1 | | 4/2001 | Helfer-Grand | |

* cited by examiner

*Primary Examiner*—Luan K. Bui

(57) ABSTRACT

Apparatus for hands-free portability, single-handed dispensing and omnipresent availability of folded and stacked pre-moistened antiseptic towelettes intended for use in the control and prevention of contact transmission of infectious disease by making frequent and effective hand and object cleansing feasible and appealing, despite the pressures and demands of contemporary life. It comprises a bag with a reflective and washable outer surface, which expands according to fullness, and two covered compartments separated by an insulated divider, one being employed for unused towelettes, and the other for soiled towelettes. Adjustable straps that include hook-and-loop fasteners in alternating configurations permit attachment of the bag to body parts, items worn and transported by users, inanimate objects, and mobile items in contact with floor and ground surfaces the movement of which is guided by users. Widely-accepted behavior modification strategies, which influence and provoke its use, are integral to the material components of the apparatus.

35 Claims, 18 Drawing Sheets

HANDS-FREE PORTABLE TOWELETTE DISPENSER APPARATUS

CROSS REFERENCE TO RELATED APPLICATIONS

This application claims the benefit of U.S. Provisional Application No. 60/130,371, filed Apr. 21, 1999, which is included herein by reference.

BACKGROUND OF THE INVENTION

FIELD OF INVENTION

The present invention relates generally to sheet and web dispensers, and more particularly to a portable apparatus for use in dispensing folded and stacked antiseptic, pre-moistened towelettes.

The United States is facing an escalating, global onslaught of infectious diseases of potentially pandemic proportions. Infectious diseases are, already, the leading cause of death world-wide, and the third leading cause of death in the U.S. The portable towelette dispenser apparatus of the present invention, hereinafter BusyBody Travel Buddy(s) (BBTB) is intended for use in the control and prevention of contact transmission of infectious diseases by making frequent and effective hand cleansing feasible, even appealing, despite the pressures and demands of contemporary life. The unique function served by the BBTB apparatus is to extend the functional contexts for application of the LIFEWORKS HAND CLEANSING SYSTEM to provide: "Contagion Control Whenever and Wherever You Go." The embodiments of the BBTB presented herein are part of a comprehensive family of product and services intended to influence, provoke and sustain healthy changes in hand washing behavior on behalf of controlling and preventing the spread of infectious diseases. "The Power of Prevention is in Our Hands"—*Control and Prevention of Contagion of Infectious Diseases,* written by the instant inventor and which is incorporated herein by reference, is considered an integral component of the present invention. It provides discussion about the history and scope of the problem, the frightening infectious disease trends we now face, the remarkably intransigent non-compliance with hand washing mandates for over 150 years, the proposed composition of a broadly germicidal, no-rinse, cleansing lotion which also benefits the skin, and much more about this the LIFEWORKS comprehensive preventive health care model. The BBTB is not intended to replace, but rather augment access to frequent antisepsis, when sink, running warm water, etc. are not available or not easily available. The role of the BBTB in the multi-purpose, systematic, systemic and synergistic whole of the LIFEWORKS HAND CLEANSING SYSTEM is also made clear in the above named document. Excerpts from that document are presented below for a more comprehensive understanding of the various embodiments of the present invention.

BRIEF SUMMARY OF THE INVENTION

The present invention is intended for use as a portable, hands-free, convenient means of dispensing antiseptic, pre-moistened towelettes in any of a vast array of situations, locations and contexts. In use, the BBTB "bags" can be used/worn/attached in multiple functional configurations, including, not limited to: (1) around an arm, wrist or ankle; (2) around the waist; (3) hung either straight down or across the shoulder; (4) removably attached to convenient object. In particular, these germicidal towelettes are available for use in preventing infection-breaking the cycle of contagion at the most strategically potent window of opportunity, immediately before eating. In addition, the BBTB is intended for use in any situation/place/time that a risk of transmission of infectious pathogens exists. As such the apparatus is intended to function as a convenient, efficient and effective means of preventing contact transmission of infectious diseases.

Although not limited thereto, the most preferred embodiment of the BBTB is made (available) in three sizes: small; medium; and large. These sizes have both over-lapping and discrete (unique) functional applications, as described below. The three models vary only in size and towelette capacity, and are, otherwise, identical. As a result, it is contemplated for the highly adaptable apparatus is to be used as a portable, convenient means of dispensing pre-moistened antiseptic towelettes in any of a multitude of locations/situations, by persons of all ages, except as limited by cognitive or physical conditions. The three sizes contemplated by the most preferred embodiment of the BBTB are:

1) SMALL—The small BBTB is intended, in particular, but not exclusively, for use by children and adolescents, beginning around 2½ years of age through high school and college. In educational settings, such as pre-school, nursery school or the like, where contagion of infectious diseases is notoriously rampant, access to bathrooms is also limited typically. Also, when available, bathrooms are often lacking all necessary ingredients for effective de-contamination of hands. Hot water, for example, is typically unavailable in order to protect children from burning themselves. In addition, when traditional hand washing means are available, young children rarely, if ever, wash and dry their hands such that effective decontamination is achieved. Further, there are multiple contagion risks in any classroom environment. Among young children, one of our four groups most susceptible to contagion, there is plentiful opportunity to spread germs on toys, books and other articles shared by children. Even if a child appears well, they can be in a particularly contagious incubation stage of an illness. As numbers of children in day care increases, so do incidences of infectious diseases. Because of the financial and other pressure on parents, children are commonly returned to day care before they are entirely well (64% of absenteeism from work is due to the need to care for a sick child). Furthermore, infectious diseases have a high transmission rate among household members, leading to further loss of income and productivity. Even if youngsters, in educational settings, use towelettes only for de-contamination before eating, this will significantly diminish the rate of self-inoculation of infectious pathogens, hereby significantly reducing the incidence of infectious diseases among children of all ages. Obviously, the classroom/school is not the only setting where antiseptic hand cleansing is critical for young people. A stop for french fries, during an after-school bike ride, exemplifies the multiple opportunities to "break the cycle of contagion" made available by the BBTB. Infections most common to this age group, staph and strep, are quickly becoming highly multi-drug resistant. This embodiment is approximately 2½"×2¾"×2" and holds 15 to 25 towelettes, with sturdily attached strap lengths appropriate for wearing or attachment to convenient objects and appropriate body parts. While specifically designed for the populations mentioned above, this BBTB model can be used by any person, of any age. Strap-ends have four-part cooperative hook and loop (or the like) material, for secure and adjustable fastening to person, clothing, or object such as purse, brief case, grocery cart, wheel chair, walker, bed rail, and much more, for effortless portability or to convenient stationary object. Permanent strap ends can also be fastened securely to pair of adjustable extension straps to secure apparatus around wrist, waist, to hang from shoulder, or other location on or off person. Quick release buckles, along with strap coupler, serve to both release and secure strap extensions at required lengths. For purposes of hand cleansing behavior modification, this size of BBTB, including straps and closure apparatus, provide children with the capability ("responsibility/honor") of transporting BBTB for the protection other family members, which can serve as a powerful positive reinforcer for disease prevention/contagion control, for children. The small BBTB also provides materials for independent self-care with respect to infectious diseases. Autonomous self-care is reported to be a high health care priority as an inordinate proportion of the health care 'bill' goes for care of the elderly. The BBTB is designed for "Contagion Control Wherever You Co." and achieves this by making effective and disinfecting and cleaning: convenient, easy, fast, pleasant and difficult to do incorrectly. Young children learn easily, particularly if taught well. A number of pre-school programs have been developed and successfully teach young children how to wash their hands properly and when. Children also tend to be acute watchdogs of parental behavior, particularly if it is unsafe or contradictory to what the child has been told. It is highly likely that young children will become drill sergeants, training other new enlistees. It is critical for both the physical and psychological well-being of our young people that they gain some sense of control over their lives and futures, which, as our world is today, appears rather bleak. By harnessing adolescent energy, we gain enormous strength toward achieving our goals. At the same time, we provide an opportunity to impact systems which appear too over-whelming and entangled to affect. A wise man advised, "Let the children lead you." Adolescents, unanimously "immortal," are likely to be a more difficult population to influence than younger children. Again, effective tools, education and reinforcement are essential. Also, as will be the case among all population sub-classes (e.g., employees at a particular site) group pressure will be a particularly potent force harnessed on behalf of changing hand cleansing behavior among pre-adolescents and adolescents. As is true of child care settings, the elementary and secondary classrooms are potent breeding grounds of disease. Bathroom access tends to be even more limited than in pre-school, and supplies often inadequate for antiseptic hand cleansing. In addition, few young people are even aware of the rules for safe hand cleansing and/or preventing re-contamination in high pathogen-loaded sites such as bathrooms. Besides, "Most have better ways to spend their time." As one school nurse described, "Dirty tissues are tossed about; pencils go from mouths to friends; food and utensils are shared (along with any pathogen passengers)." However, absurd this may sound at initially, adolescents actually appreciate rules. They also crave some measure of power in their lives (as is fitting with their developmental tasks) of which little is available. Given proper equipment and training, adolescents can be influence to become avid representatives of the assumption of personal responsibility for one's own health as well the health of others. The small embodiment of the BBTB is also useful for elderly persons, another of the four population groups most susceptible to infection. Systems are being sought to enhance independent self-care among the elderly. The small BBTB not only serves this function effectively, but will also reduce the excessive health care costs associated with the elderly.

2) MEDIUM—The medium BBTB is intended, in particular, but not exclusively, for use by adults. This embodiment is approximately 8" long×3"–4" deep (expandable)×4" high and holds 40 to 50 towelettes (double by also using disposal compartment for fresh towelettes if fits needs better), with sturdily attached strap lengths appropriate for wearing around the waist, other body parts, or attachment to convenient objects. Strap-ends have four-part cooperative hook and loop (or the like) material, for secure and adjustable fastening around body part, object, etc.; apparatus strap ends can also be fastened securely to pair of adjustable extension straps to secure apparatus around waist, to hang from shoulder, or other location on or off person. Quick release buckles, along with strap coupler, serve to both release and secure strap extensions at required lengths. This BBTB embodiment is specifically intended for, but its use is not limited to, the adolescent/adult population. However, all of the functional applications described above are also applicable to this medium size BBTB. The adult frame can more easily carry the medium and large size BBTB than can small children. In use, parents, for example, can access a sufficient number of towelettes to meet anticipated needs for child (children), and/or self (selves) for: marketing, a day of errands and/or recreation, fast food stop(s), a the work desk. Adults as well as children are constantly touching sources of contact transmission of pathogens. Children are particularly likely to do so, often at every opportunity. Contaminated hands will transmit pathogens to food, to eyes that are rubbed, etc. This apparatus is intended to provide frequent opportunities to "break the cycle of contagion" by making frequent hand cleansing readily available, fast, easy and efficient. The medium size BBTB approximates the familiar "fanny pack" in both size and shape, and could be worn around the waist in addition to same. This embodiment is functionally inter-change with the two other BBTB apparatus sizes, with the exception of towelette capacity. The extension straps described for the 'around the waist' model will be available for all three BBTB models. The medium embodiment of the BBTB is perfect for innumerable "out-of-home" & "outside-of-work" situations where truly antiseptic hand cleansing is required in order to prevent hand transmission of contagious pathogens. Among these are: drive through fast-food stops, at the market or any other shopping, in the car, workshop, health club, carried in luggage, beach or sports bag, at the park &/or picnics, at the beach, the zoo &/or petting zoos, amusement parks, camping, barbecues, boating, fishing, golfing, other sports as player or viewer, exercising, sun bathing, biking and much more. The BBTB can also be worn in the home as an ever-ready means of convenient antisepsis and/or disinfectant.

3) LARGE—The large BBTB is intended, in particular, but not exclusively, for families and large groups. This embodiment is approximately 8½"×5"×6" and holds approximately 150 towelettes (double by also using disposal compartment for fresh towelettes if fits needs better), with sturdily attached strap lengths appropriate for attachment to convenient objects. Strap-ends have four-part cooperative hook and loop (or the like) material, for secure and adjustable fastening around the waist, over a shoulder, and attachment to inanimate or mobile objects, etc.; apparatus strap ends can also be fastened securely to pair of adjustable extension straps to secure apparatus in a convenient location readily accessible for use. Quick release buckles, along with strap couplers, serve to both release and secure strap extensions at required lengths. The large BBTB embodiment is specifically intended for, but its use is not limited to, situations likely to require the availability of a larger number of antiseptic towelettes than can be accommodated by small and medium-size BBTB's, such as many 'out-of-home' situations. It is particularly important that an antiseptic towelette be insulated from the affects of sunlight, moisture, heat, environmental contamination, whether in the car, at a little league game, or on the beach. Design of Large BBTB is identical to Small and Medium Sizes except for its greater depth and related towelette capacity. The large BBTB, as the small and medium size BBTB, is a multi-purpose apparatus. It provides hands-free portability in that it can be worn around the waist, hung from either shoulder, or the like. However, it is specifically intended for placement on or about (including hanging from) a (temporarily) stationary location, thereby conveniently providing a large supply of towelettes when same is required for a particular usage situation. As such, the functional application of the large BBTB embodiment include, but are not limited to use for more than one person; lengthy and/or high pathogen risk activities; to have sufficient number of towlettes conveniently use, e.g. for a full week at the work place; automobile travel -including short trips, day trips and longer travel; recreational events such as- picnic, beach, sporting events, concerts, camping, and the like.

The BBTB provides contagion control and prevention of contact-transmitted infectious diseases (includes food-borne pathogenic microorganisms) by making effective antiseptic hand cleansing conveniently available, fast, easy, pleasant and effective in any setting and/or circumstance. A foremost paradigm shift in this apparatus is to extricate hand washing from its bondage to a sink with running water. THE LIFEWORKS HAND CLEANSING SYSTEM, of which the BBTB is an important component, is replete with systems of behavior modification most likely to achieve this objective of sustained increase in effective decontamination of hands. The foremost purpose/function of the BBTB being to break the cycle of contagion by way of facilitating frequent disinfecting of hands without drying or irritating the skin, as well as multiple other germicidal functions. In conjunction with: 1) the multiple integral behavior modification strategies that produce effortless learning and habit formation; and the education and training included in the LIFEWORKS HAND CLEANSING SYSTEM, the immediate accessibility of the BBTB implements a practical, realistic and universally acceptable system with which to implement education, training, and related reinforcement strategies.

Although the most likely age sectors and methods of 'hands-free' portability are indicated below, all BBTB embodiments are designed to be universally adaptable across the age span beginning around age two.

BRIEF DESCRIPTION OF THE SEVERAL VIEWS OF THE DRAWINGS

The preferred embodiment of the present invention is described in detail below with reference to the attached drawings, wherein.

DETAILED DESCRIPTION OF THE INVENTION

Figure 1:
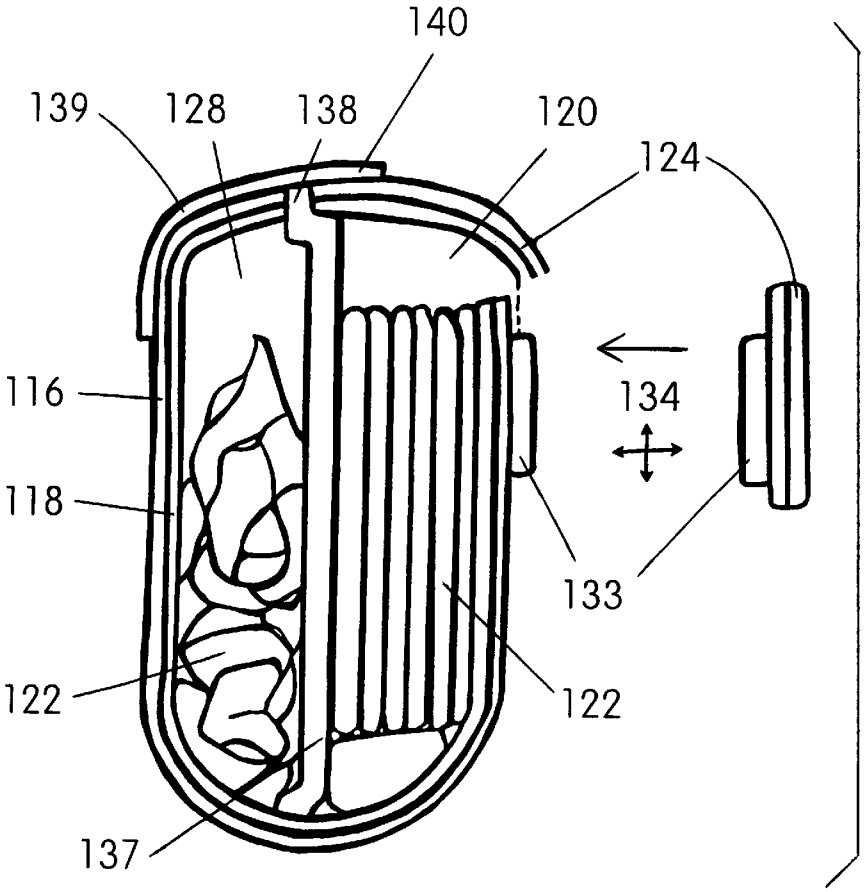
FIG. 1 is a sectional side view of the small embodiment of the BBTB, illustrating various components forming a part thereof.

The apparatus (FIG. 1) is an insulated, expandable, easily refilled travel bag for pre-moistened towelettes, and broadly includes a durable, reflective outer layer 116, covering a heavy-duty, water-resistant inner fabric layer 118. An excellent radiant barrier such as "U-B Kool" (™) which is constructed with a thin Mylar center with thin aluminum on either side, will radiate external heat away from BBTB. The outer layer, 116 is designed to present and easy to clean surface that can be cleaned and sanitized by a pre-moistened towelette, while the inner layer 118 serves the function of retaining the moistening composition in the towelettes during storage. Heavy duty stitching material, used throughout apparatus, is intended to add to durability 143.

The bag includes a first expandable compartment 120 sized for receipt of a stack of separated, individual pre-moistened towelettes 122. An easy access, sturdy but flexible cover 124 is provided for the compartment. The cover is secured over the opening of the compartment by hook-and-loop fastening strips or the like. These sturdy hook and loop fastening materials 133 (FIG. 1) are securely stitched to the bag, and have cooperative hook-and-loop fastening material permanently attached to the interior of the removable covering. The size and positioning 134 (FIG. 4) of these engaging materials allow closure of the removable cover at various positions in order to accommodate greater or lesser fullness of either one or both compartments. This variable attachment capability is intended to allow BBTB to remain as compact as contents permits, thereby maximizing ease of transport, and minimizing any awkwardness or other problem presented by BBTB volume/size. This snug closure also prevents unnecessary loss of moisture from fresh towelettes in storage or contamination by matter external to the bag.

A second compartment 128 is provided in the bag that is generally co-extensive with the first compartment with a sturdy but flexible removable cover 139 fitting, snugly against compartment divider or the like. This removable cover has a co-extensive end-piece 140 which attaches to the dispensing department cover 124 by hook and loop fastening material or the like, and is also adjustable to accommodate content volume. This easy access lid can be opened for single-handed disposal of used towelette, without also opening the storage compartment for fresh towelettes to be deposited in an appropriate receptacle when such is available.

Figure 5:
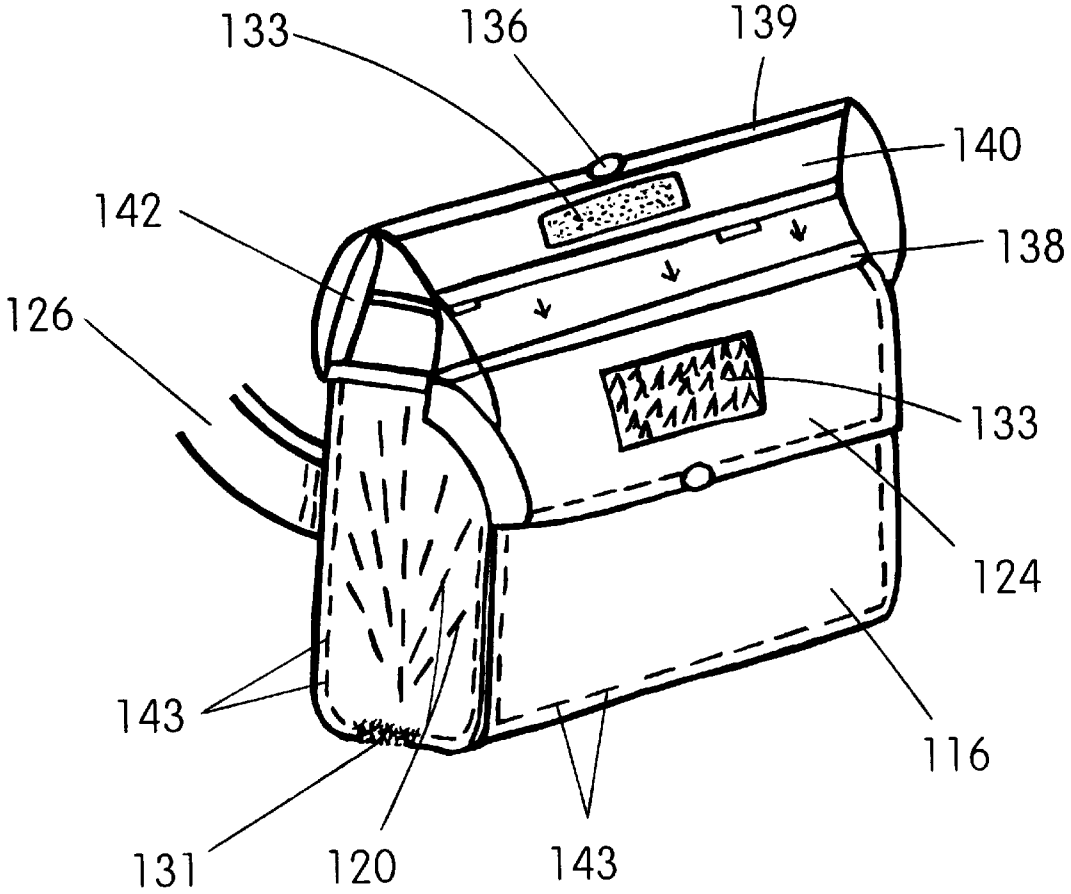
FIG. 5 is a perspective view of the small embodiment of the BBTB illustrating various components forming a part thereof while the cover of the disposal compartment is open.

The cover 124 (FIG. 1) for dispensing compartment 128, is contiguous with the uppermost end of compartment divider 138, to which it is securely attached via heavy-duty stitching, or the like. The disposal compartment 128 (FIG. 5) can be removably covered by 139. A sturdy moisture-resistant extension 137 (FIG. 1), or the like, perpendicular to mid-section between rear cover parts 139 and 140 (FIG. 5) closes snugly, adjacent to inner side of divider #138. This disposal compartment cover has a co-extensive additional length of reflectant, water-resistant covering 140 which over-laps dispensing department cover 124 (FIG. 5). Hook and loop fastening material, or the like, secure this extension of the disposal department cover to the dispensing department cover 124 (FIG. 5). Each compartment can thusly be opened independently, preventing unnecessary exposure of fresh towelettes to soiled towelettes and/or other environmental contaminants.

Figure 2:
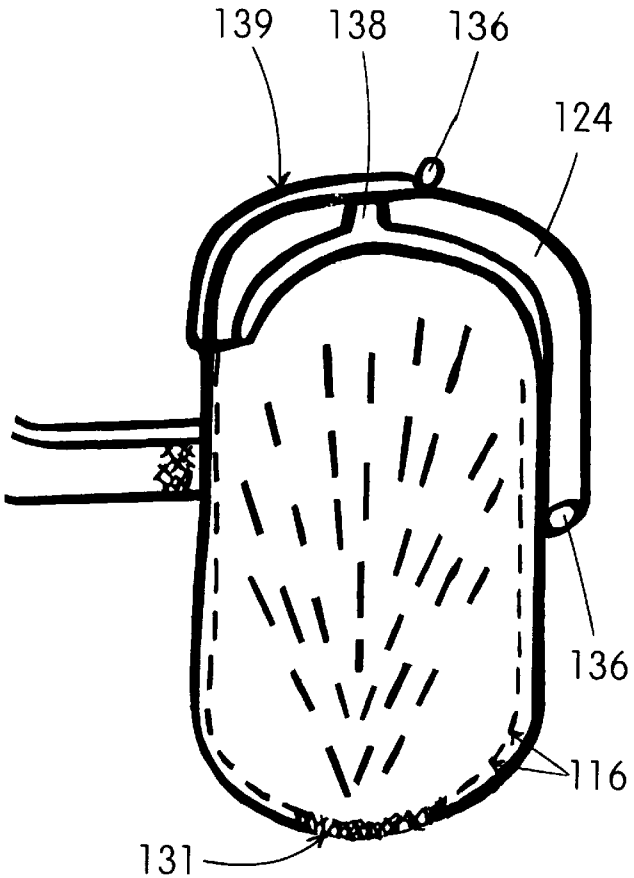
FIG. 2 is a side view of the small embodiment of the BBTB, illustrating the covers of the apparatus and pressure clip.

Sturdy elastic or, the like 131 (FIG. 2), at base of BBTB serves to gather material, as such, facilitating expansion and contraction of the bag. In use the bag also folds inward on itself 132 to accommodate to fullness of either or both compartments. In use, the fully expanded bag accommodate approximately 18–20 towelettes in storage and/or disposal compartments. A sturdy divider 137 (FIG. 2) separates dispensing and disposal compartments. Divider is constructed of heavy duty, moisture-proof materials to prevent air and/or moisture exchange between the two compartments.

Figure 4:
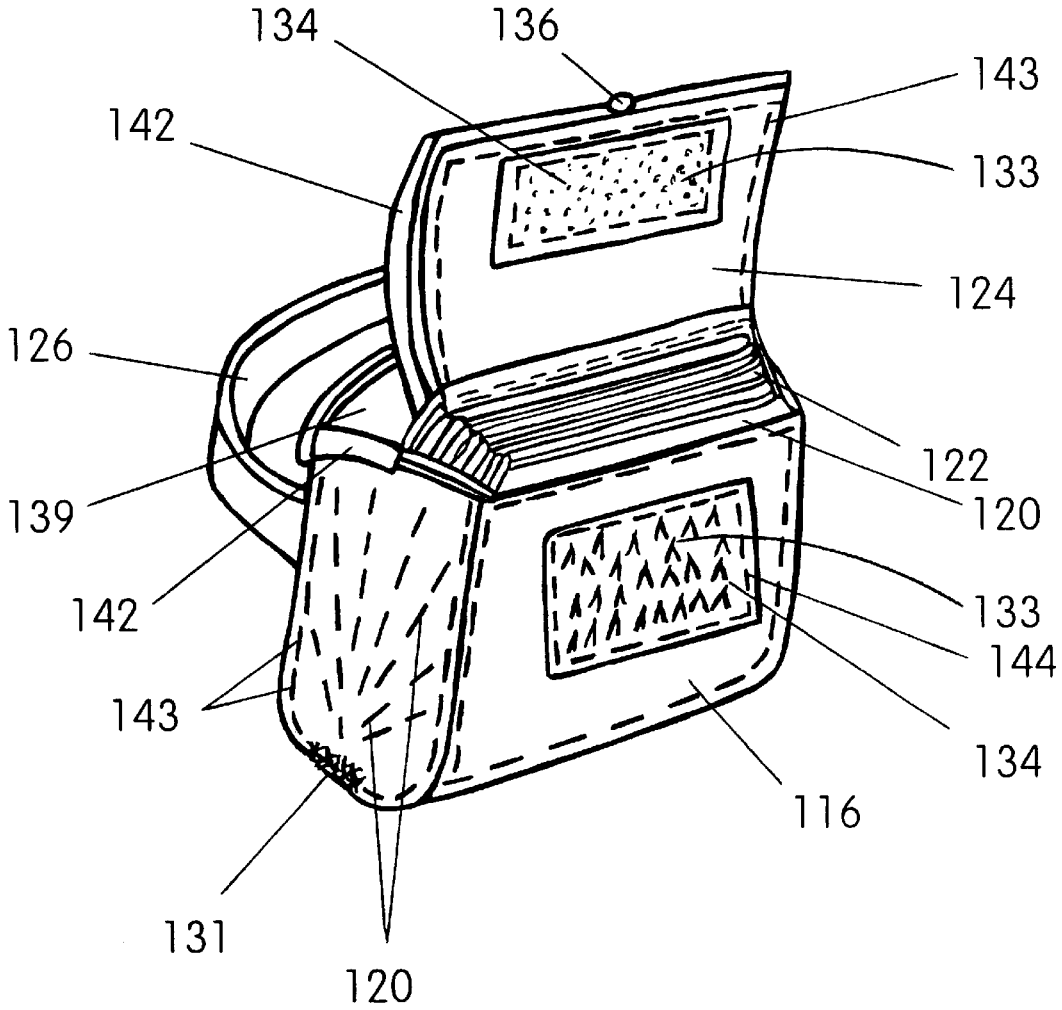
FIG. 4 is a perspective view of the small embodiment of the BBTB illustrating various components forming a part thereof while the cover of the dispensing compartment is open.

Cover for dispensing (FIG. 4) compartment 124, is contiguous with the uppermost end of divider 138, to which it is securely attached via heavy-duty stitching, or the like, to this divider. The disposal compartment can be removably covered by 139 (FIG. 4). A sturdy moisture-resistant extension 137, or the like, perpendicular to mid-section between rear cover parts 139 and 140 (FIG. 5) closes snugly, adjacent to inner side of divider 138. This disposal compartment cover has a co-extensive additional length of reflectant, water-resistant covering 140 which over-laps dispensing department cover 124. Hook and loop fastening material, or the like, secure this extension of the disposal department cover to the dispensing department cover 124. Each compartment can thusly be opened independently, preventing unnecessary exposure of fresh towelettes to soiled towelettes and/or other environmental contaminants.

In use, a pressure clip, either a single or double ring shape 136 (FIG. 5), rectangular tab 141, or the like, can be used for instant, secure attachment and easy removal of either cover 124 or 139 and 140. An individual towelette can either be extracted or disposed of using the same single hand also used to either open or close removable covers.

In use, a towelette is removed from the storage/dispensing compartment 120 by lifting the front cover 124 and removing a single towelette from the stack 122 stored therein (FIGS. 4 & 5). Once cleaning is completed (whether used for hands, diapering, toileting and/or disinfecting), the towelette can then be disposed of by lifting the two-part cover of the second compartment 139 and 140 and placing the soiled towelette in the temporary disposal compartment 128 (FIG. 5). After the user arrives at a destination having a trash can or the like, the used towelette is removed from the disposal compartment and deposited there in.

Figure 6:
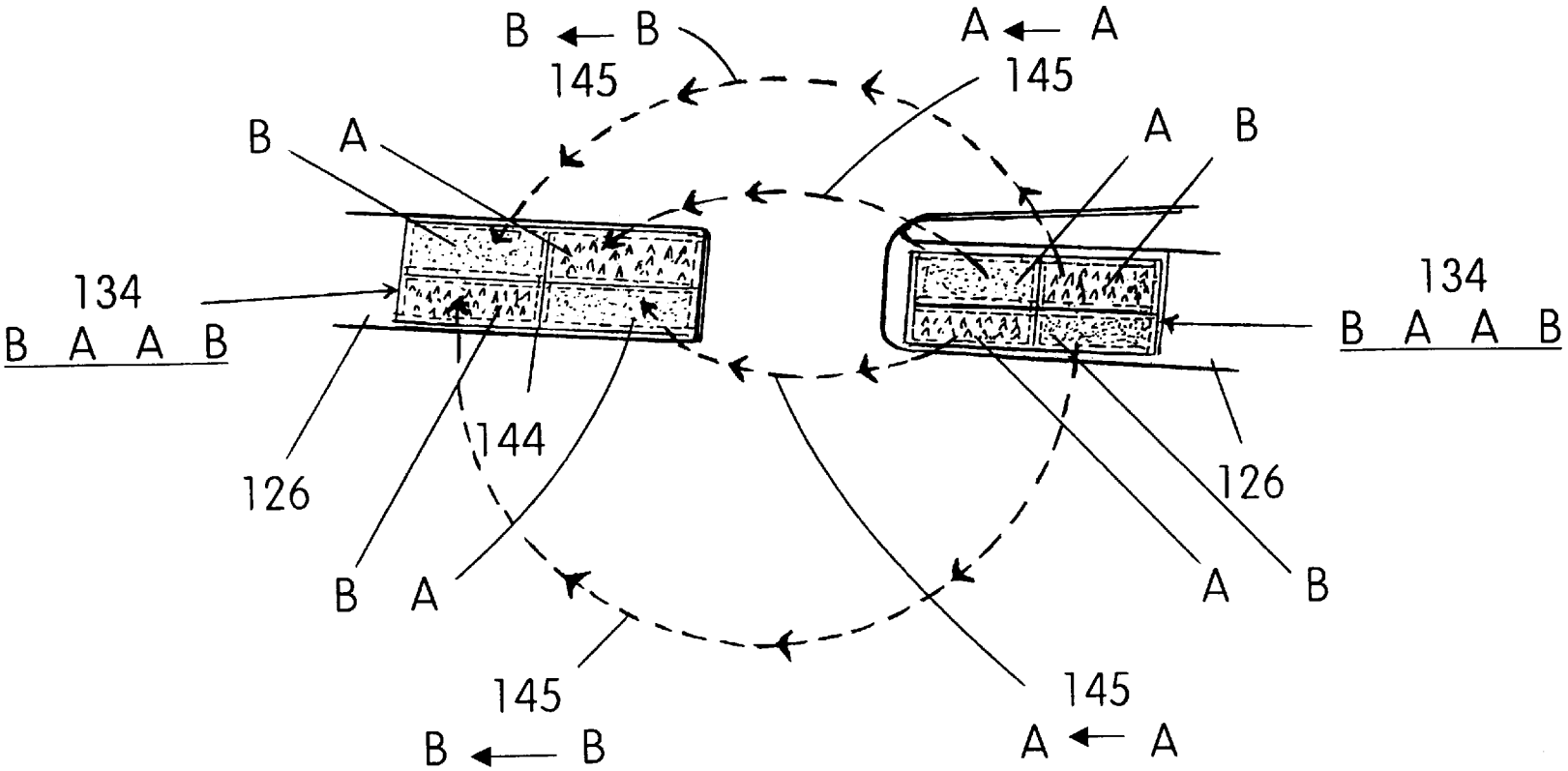
FIG. 6 is a front view of the distal ends of the permanent straps with multi-configuration/purpose closure.

Each of the two permanents sturdy, woven, water-resistant apparatus straps 126 (FIG. 6) have at their distal ends, the entirety of a four-part hook and loop(or the like) multi-configuration/multi-purpose, closure apparatus 134. In use, firm and secure attachment of the two complementary 4-part closure apparatus is achieved applying slight pressure upon the joined ends closure sections 145 ('joining' described below) of the two permanent apparatus straps 126. In use, one strap end, with closure hook and loop closure configuration facing down, is placed upon complementary closure configuration with hook and loop material (or the like) facing upward, thereby joining parts 'A' (FIG. 6) of each strap-end, and also joining parts 'B' of the complementary strap-ends (FIG. 6). In use, this can also be seen as laying the closure end of one permanent apparatus strap 126 upon the complementary end of the other permanent apparatus strap 126 closure configuration 134 for adjustable, but secure attachment of two ends 145 (FIG. 6). The loop (or the like) 4-part closure apparatus configuration 134, in use, allows the closure position to be adjustable within approximately a 1" range to accommodate to the size of human anatomical part or object around which straps are placed and then securely adjoined. In use, the apparatus straps and closure mechanisms provide effortless portability and immediate accessibility via attachment around a wrist or ankle (child), book bag, lunch box, back-pack, belt loop, bicycle, gym bag, purse, brief case, and more. In use, the multi-configuration hook and loop closure configuration provides other functional options. The BBTB can also be placed upon, attached to/about, or hung from a conveniently available stationary surface as required by the user at any particular time. In use, these surfaces include, but are not limited to: school desk, locker/cubby, desk at occupational site, coat or other 'rack' or the like for convenient access to antiseptic wipes and temporary disposal of same, until they can be disposed of in appropriate trash receptacle. In use, these multiple 'hands-free' functional options provide "Contagion Control Whenever & Wherever You Go."

As such, the apparatus is intended for use as a portable, convenient means of dispensing antiseptic, pre-moistened towelettes in any of a multitude of situations, locations and contexts. In particular, these germicidal towelettes are available for use in preventing infection (break the cycle of contagion) at the most strategically potent position—that is, immediately before eating. In addition, the apparatus is intended for use in any situation/place/time that a risk of transmission of infectious pathogens exists. As such the apparatus is intended to function as a convenient, efficient and effective means of preventing contact transmission of infectious diseases.

Additional functional versatility of available apparatus configurations, described below, is intended to meet the needs of almost the entire age spectrum and as well as educational, vocational and recreational situational requirements. These configurational systems are also universally adaptable. The apparatus configurations include: 1) apparatus strap-apparatus strap; 2) individual apparatus strap-end closures folded in on itself so as to surround and be secure around relatively small perimeters such as belt loops; 3) apparatus straps, without extension straps, each with quick release buckle components; 4) one apparatus strap with one of two-part and the other apparatus strap attached to a single adjustable extension strap with complementary buckle apparatus, and, (5) each of 2-part quick release buckle apparatus is engaged by a single removable extension strap. As such, the hands-free apparatus can be tailored to achieve maximum flexibility in meeting individual/situational requirements for 'hands-free' portability.

Figure 3:
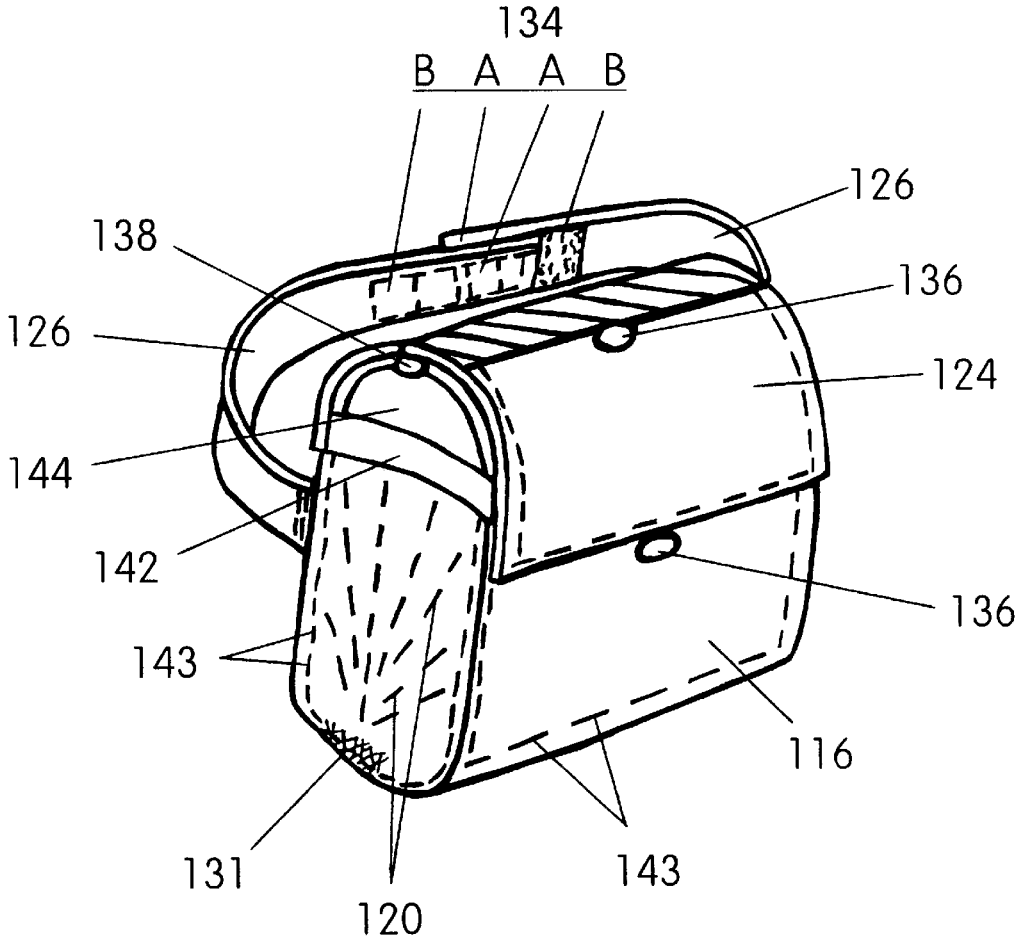
FIG. 3 is a perspective view of the small embodiment of the BBTB illustrating various components forming a part thereof while the covers are closed.

A pair of sturdy straps 126 (FIG. 6), having cooperative hook-and-loop fastening strips, or the like, 134 at the distal ends, are securely and permanently attached to the side/rear of the BBTB by sturdy double stitching, or the like 135 (FIG. 3). In use, the alternating pattern of four hook and loop fastening sections (or the like) 134 (FIG. 6) provides for multiple secure attachment configurations and multi-purpose functioning.

Figure 7:
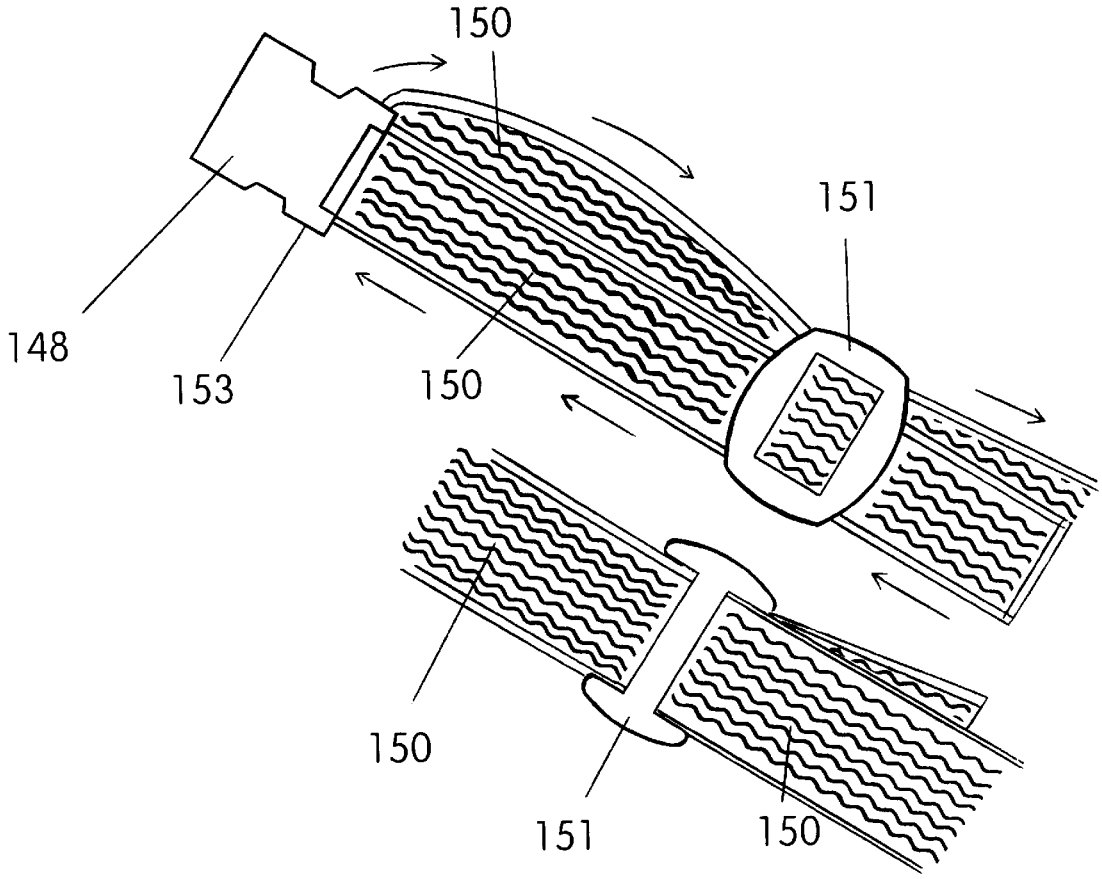
FIG. 7 is a top view of the removable extension strap pair with coupler and one-half of a two-part buckle apparatus.

Functional configuration #2: In use, the permanent strap-end 4-part configuration can be folded vertically 144 (FIG. 6), at its center such that the two joined complementary sets of hook and loop material provides secure attachment around belt loops, straps, or the like (FIG. 7). In use, each strap-end closure configuration can be folded back on itself, in order to secure closure around belt loop, or the like by moderate pressure, using only one hand, upon joined parts A and B (FIG. 6). In use, the secure joining of parts A and B of the four-part closure configuration is adjustable up to approximately one-half inch. Each of the two strap-end closure apparatus can attached around a separate item/location, such as two belt loops, bag straps, or the like.

Figure 8:
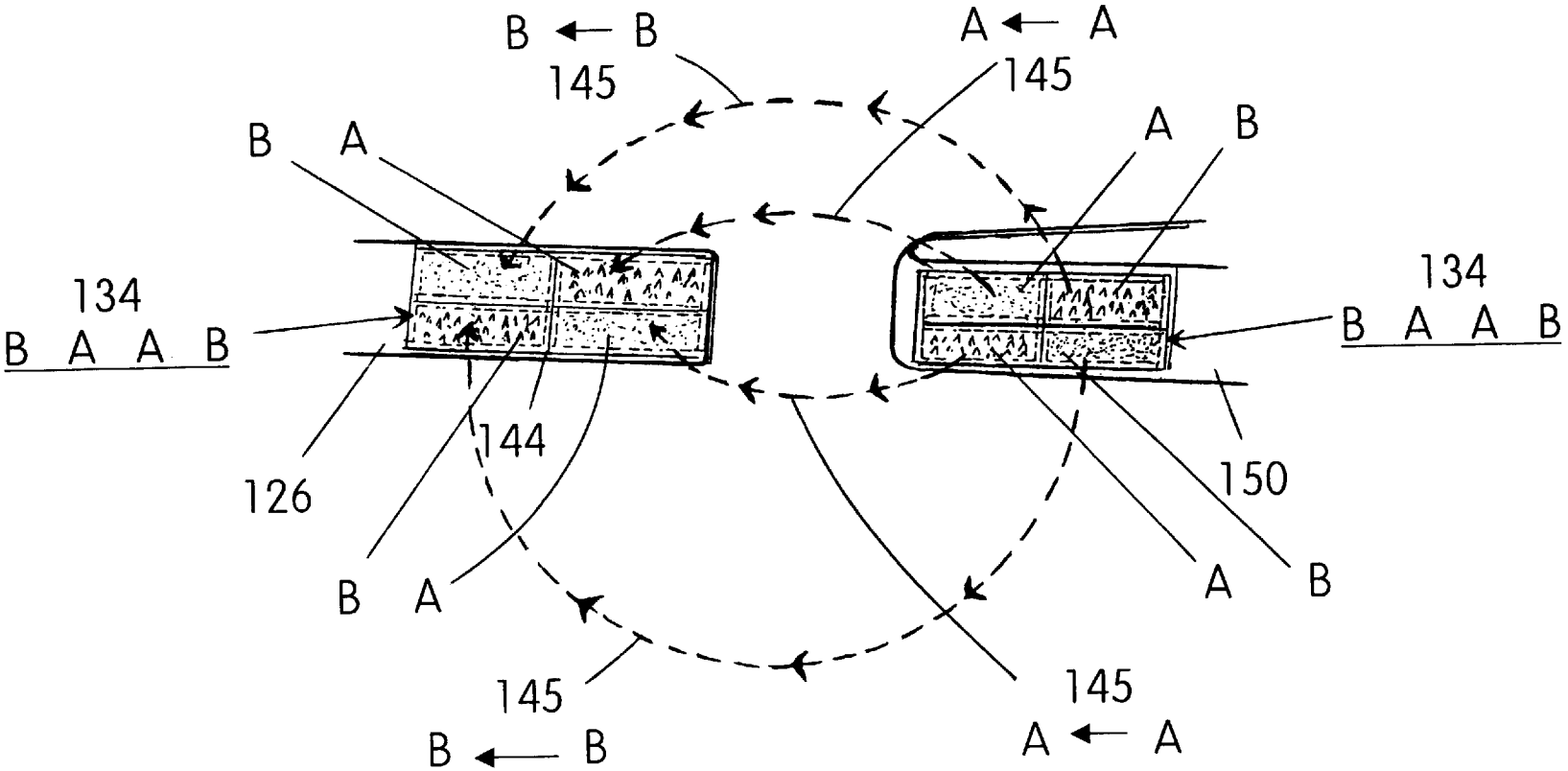
FIG. 8 is a front view of the multi-configuration/purpose attachment/closure apparatus usable between the permanent strap-end and the extension strap-end.

In addition, each of two adjustable, removable, sturdy, woven, water-resistant extension straps (FIG. 7) has, at one end, the same style hook and loop (or the like) multi-configuration attachment 146 (FIG. 9) found at the end of each permanent apparatus strap 126 (FIG. 5). The configuration of the cooperative hook and loop (or the like) components at the end of each extension strap #146 complements the configuration 134 at the end of each apparatus strap 126, creating a secure closure between the two 145 (FIG. 8) by securing all four cooperative components of the hook and loop (or the like) multi-configuration attachments, thereby extending the length of the apparatus strap as required for other usage configurations.

In addition, a two-part quick release buckle 152 (FIG. 9) can be optionally engaged either to the permanent apparatus strap end(s) 126 (FIG. 9) and/or extension strap(s) 150 for further functional configuration options. This sturdy quick-release buckle is engaged by a slight compression of the prongs of the male portion of the buckle 149 (FIG. 9), followed by easy insertion of this apparatus into the female buckle component 148. Upon engagement of the two buckle parts, here-to-fore compressed prongs of male component 148 expand to create a secure locking together of the two buckle parts. Release of the locking mechanism is achieved easily, reliably and quickly by compressing the exposed sides of now centrally located prongs and gently pulling them apart. Either permanent strap-ends 126, or extension strap ends 150 can be engaged within buckle apparatus by insertion within the enclosed distal ends 153 of each buckle component.

Figure 11:
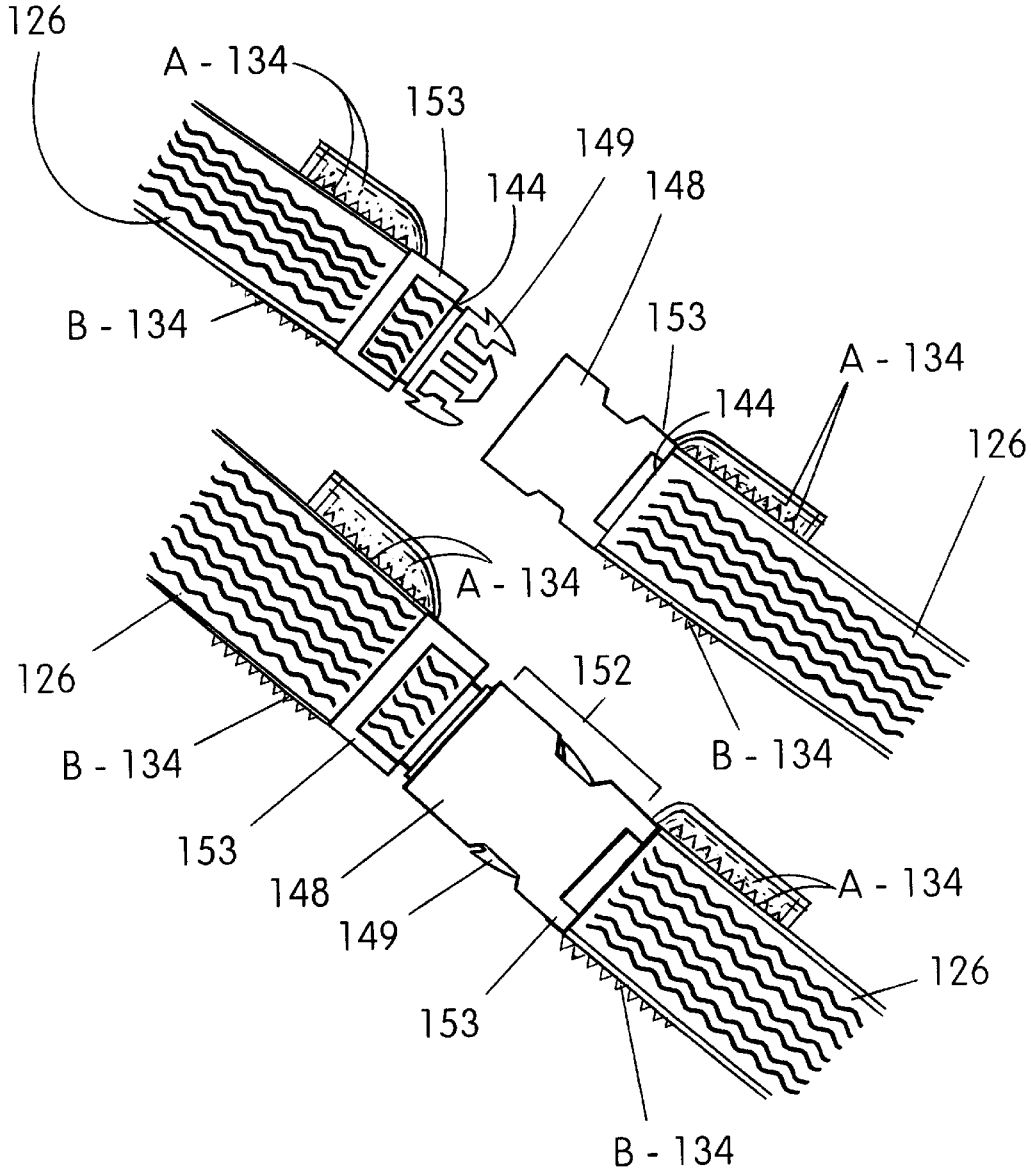
FIG. 11 is a front view of the strap-end multi-configuration closures engaged in quick-release buckle.

At the medial end of each extension strap is one part of a two-part quick-release buckle apparatus 152 (FIG. 11). As such, one end of each extension strap is placed through the distal end 153 (FIG. 11) of one of the two quick-release buckle apparatus, and then folded to complete a removably attached extension strap which, in use, can be doubled in length. In use, each buckle apparatus component is engaged and maintained within the folded (doubled in length) extension strap length by the strap couple 151 (FIG. 7).

Figure 9:
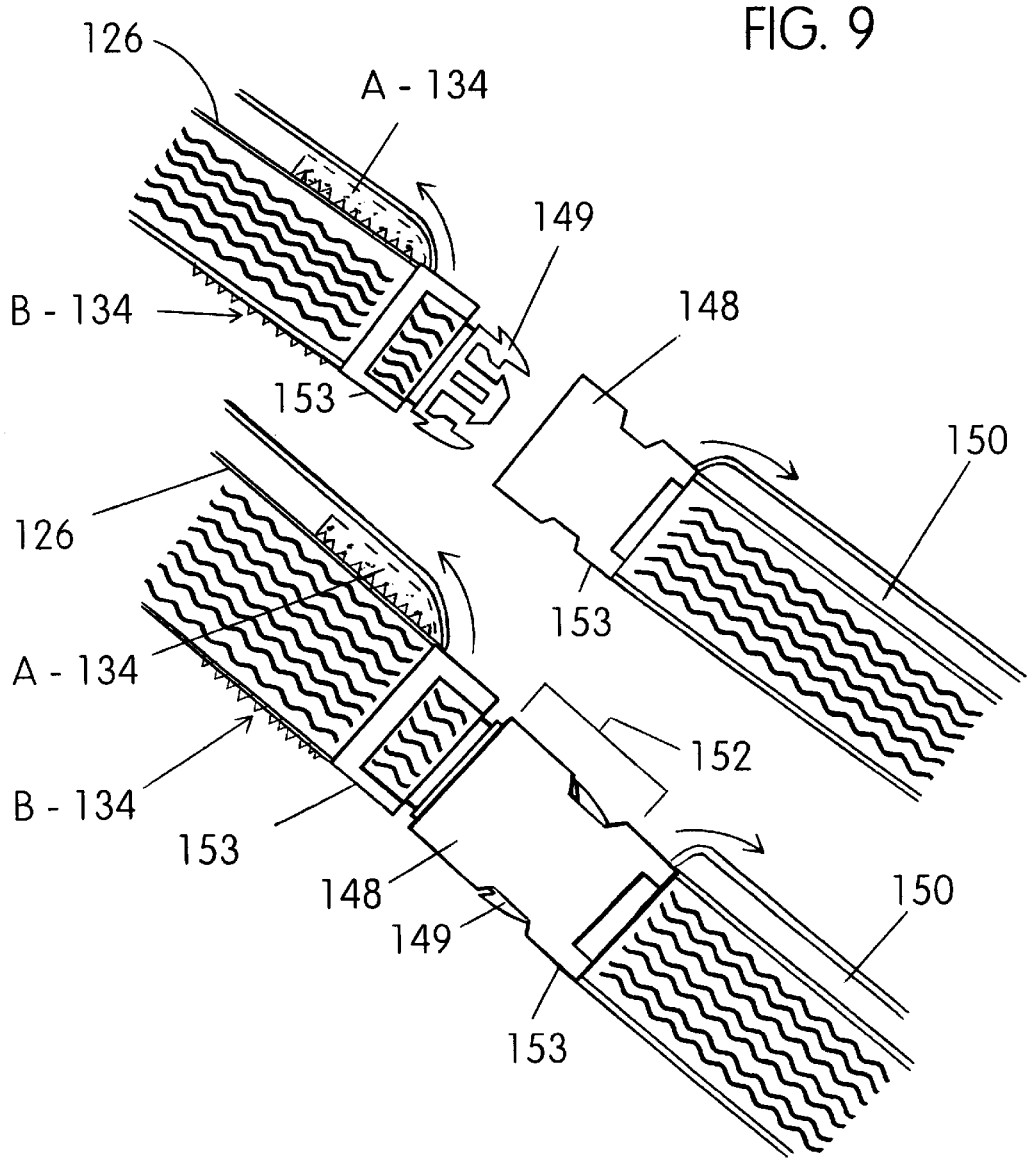
FIG. 9 is a front view of the two-part buckle apparatus used with the small around the waist embodiment having a single extension strap.
Figure 10:
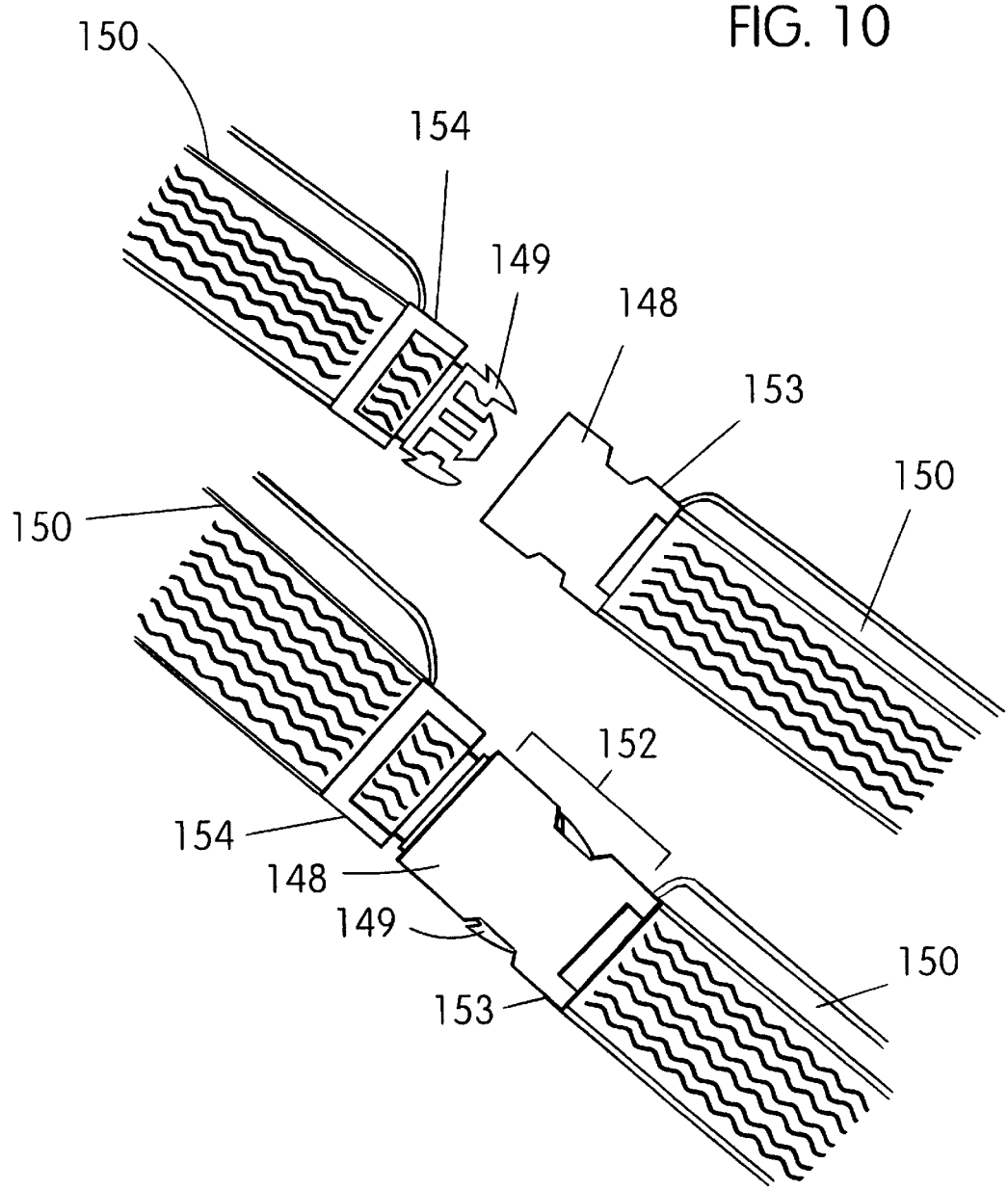
FIG. 10 is a front view of the extension strap set with quick-release buckle components.

In use, one-half of each apparatus strap-end closure apparatus 134 is placed through the distal end 153 of one of two quick-release buckle components, 148 and 149 (FIG. 9). In use, this single strap-end closure apparatus is folded, with hook and loop material facing, at its vertical center 144 (FIG. VI) so as to securely join parts A and B of the strap end around each buckle component (FIG. 11). Thusly folded, each half of the four-part hook and loop (or the like) closure apparatus faces its complement (i.e. parts: A to A and parts B to B), and, with slight pressure upon the joined end-closure components, firmly secures the buckle component within the strap-end (en)closure apparatus. The extension strap 150 (FIG. 9) has, at its medial end, the complementary quick release buckle component #148 required to engage and lock the two buckle parts together 152. In use, slight inward pressure on both prongs of male buckle apparatus 148 (FIG. 11) enables the user to easily slip that apparatus 148 into the female buckle apparatus 149 to create a 'locked' closure 152. In use, the two components of the quick-release buckle are easily detached by applying slight inward pressure on the prongs 148 which comprise easily accessed central protrusions of the attached buckle apparatus. As such, very slight pulling, if parts do not naturally separate due to gravity, results in opening and separation of the two quick release buckle apparatus. This action can easily be completed with the use of a single hand. In this apparatus configuration, the extension strap can be approximately doubled in length. A strap coupler 151 (FIG. 7) is intended for manual release of strap for purposes length adjustment. In use, this coupler maintains the adjustment until further manual changes are required.

In use, this pair of adjustable extension straps 150 (FIG. 7) extend and secure (FIG. 7) the required strap length for "around the waist" hands-free portability. As such, antiseptic towelettes can be, effortlessly, conveniently available in a familiar and efficiently functional system. A strap coupler 151 (FIG. 8) is used for manual release of extension strap to both adjust and secure strap length as uniquely required for the individual/situation.

Figure 12:
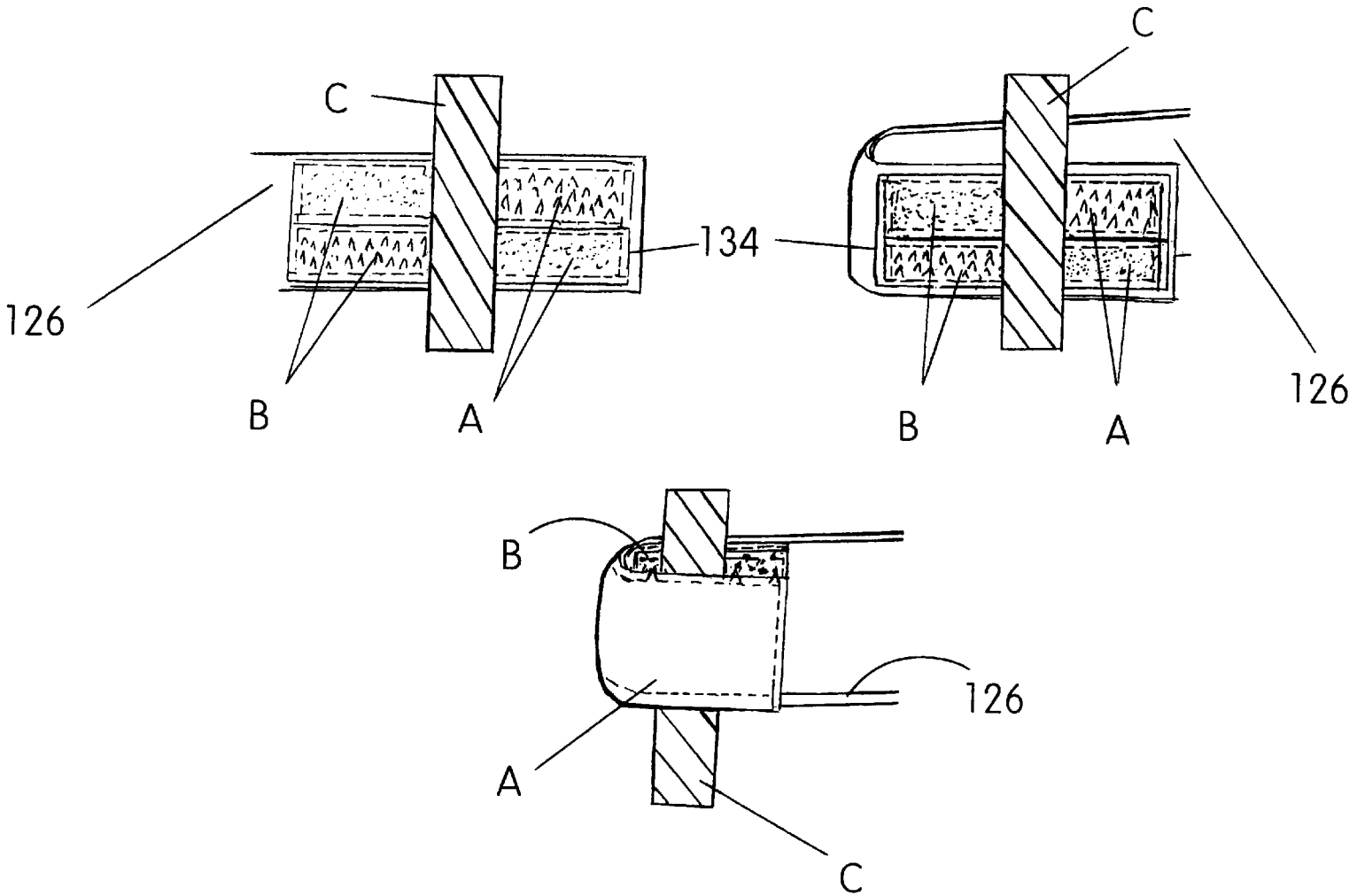
FIG. 12 is a front view of the permanent strap-end closure configuration while engaging belt-loops.
Figure 13:
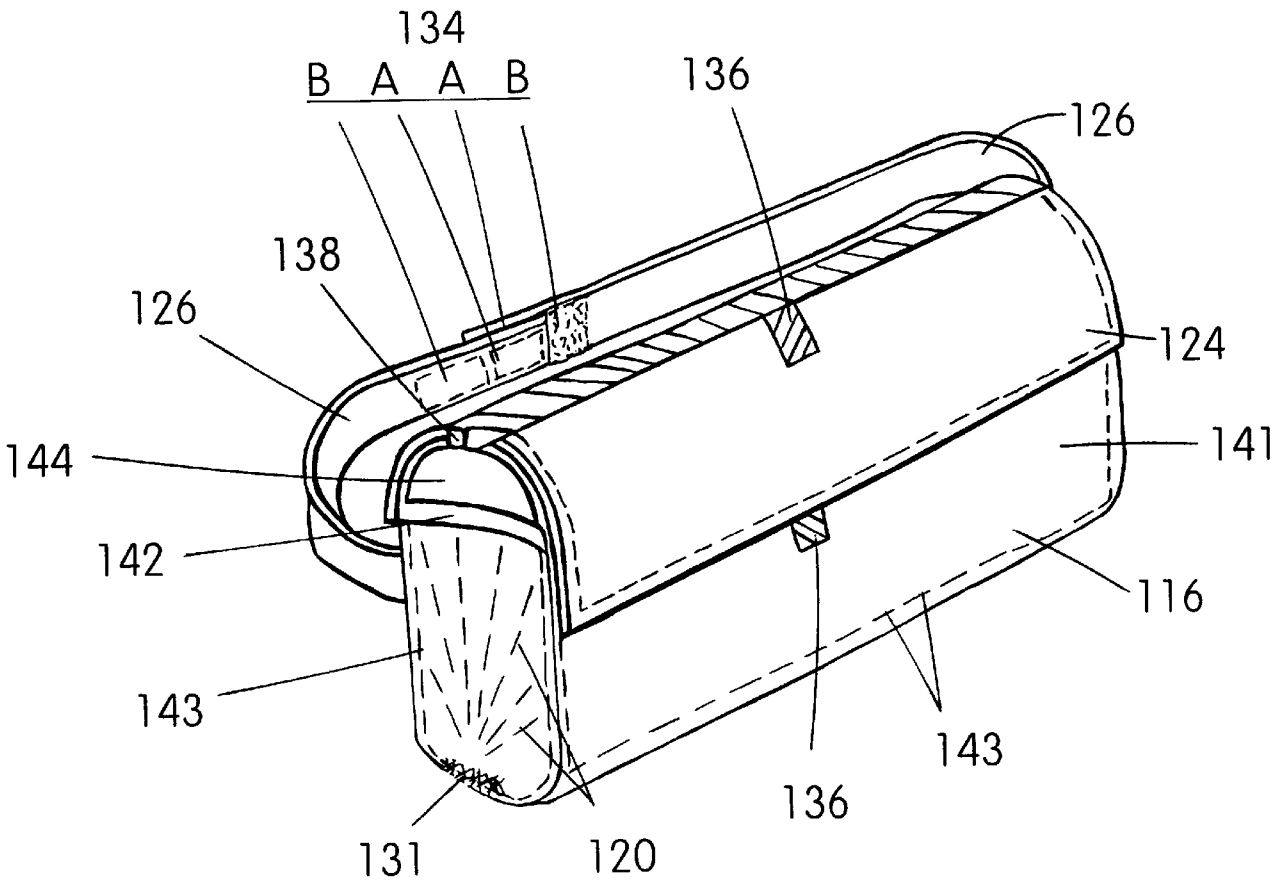
FIG. 13 is a perspective view of the adult medium embodiment of the BBTB with all covers closed.
Figure 14:
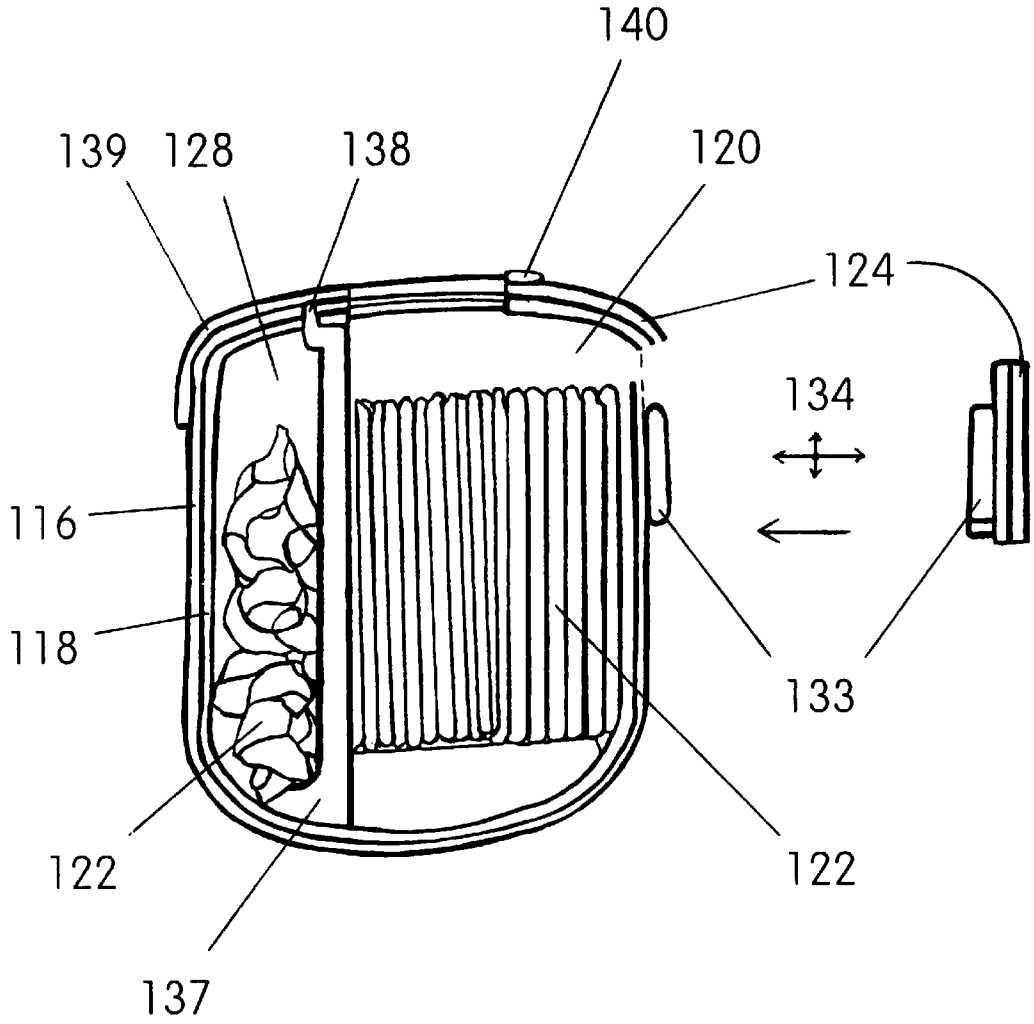
FIG. 14 is a sectional side view of the adult medium embodiment of the BBTB.
Figure 15:
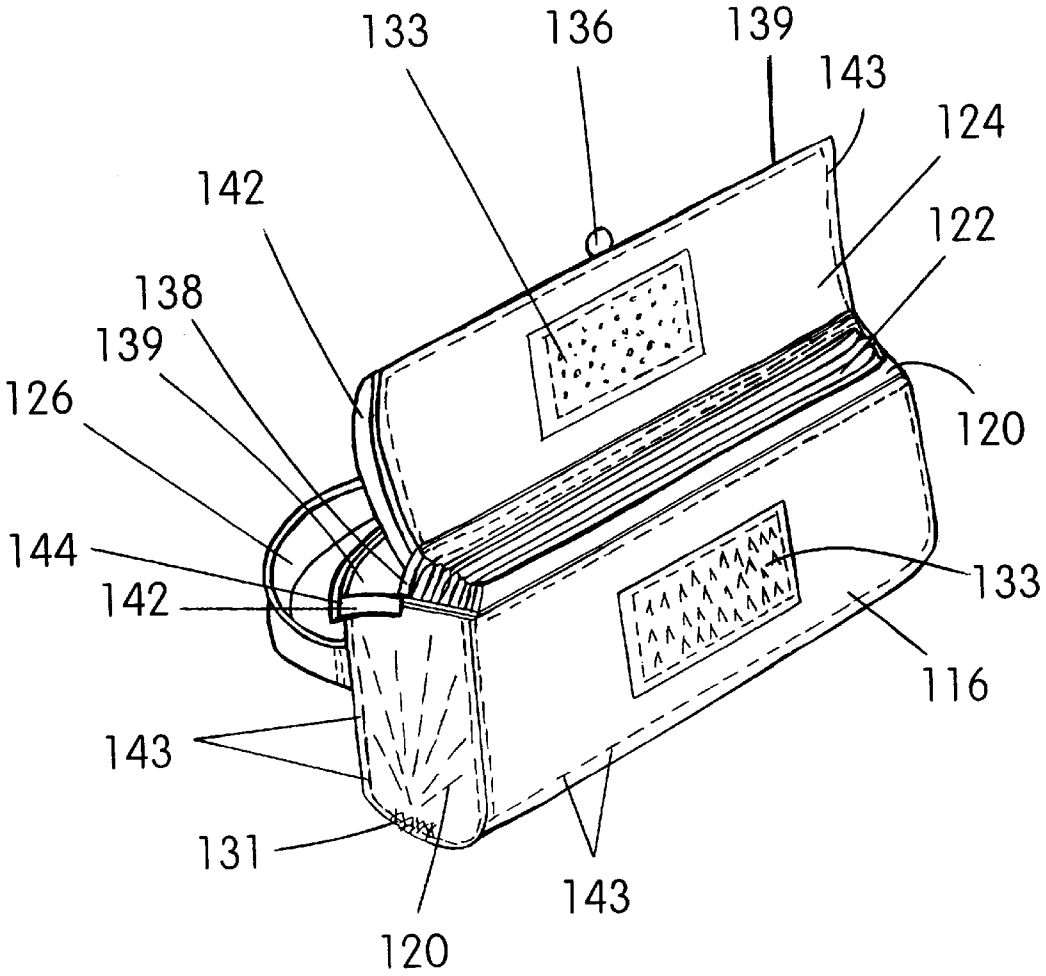
FIG. 15 is a perspective view of the adult medium embodiment of the BBTB with the cover of the dispensing compartment open.
Figure 16:
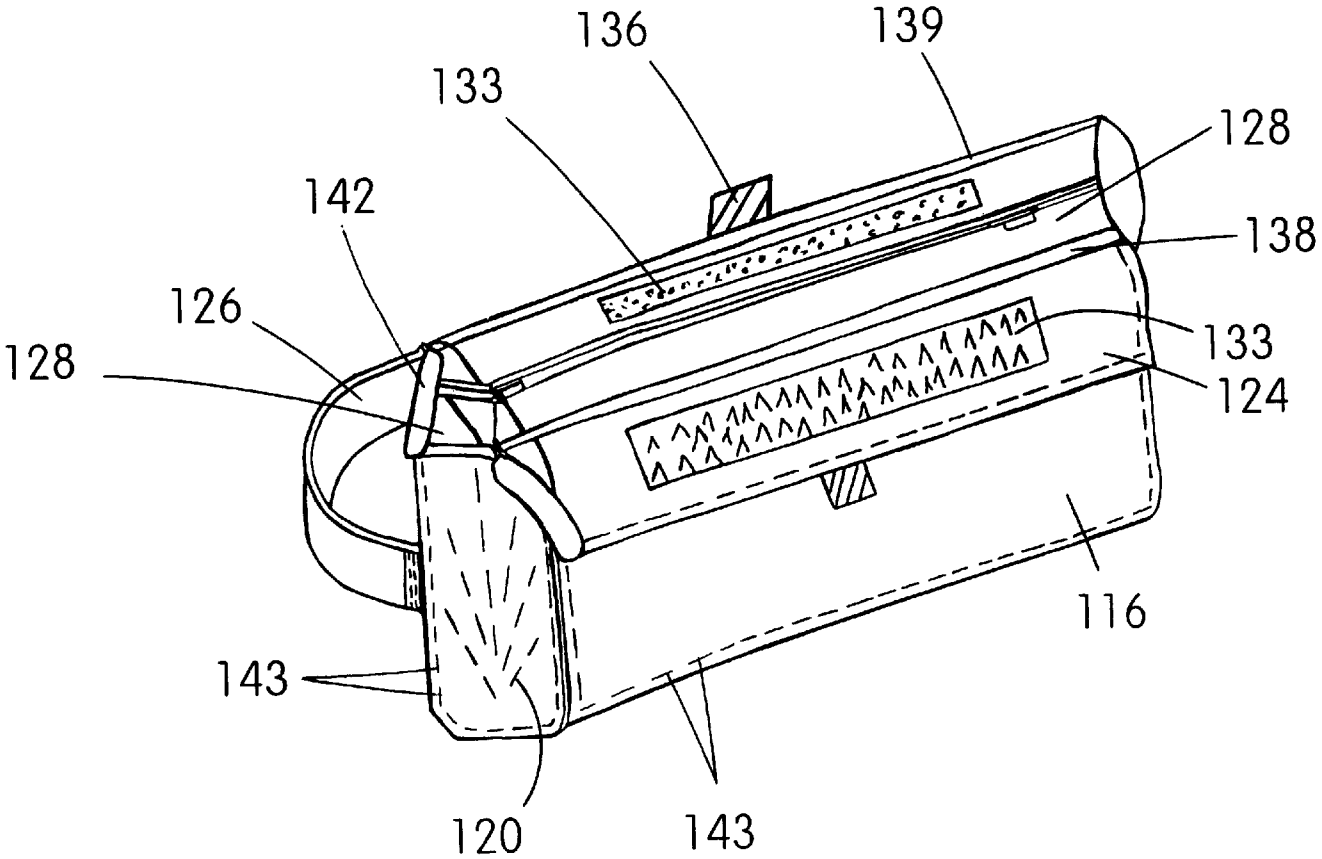
FIG. 16 is a perspective view of the adult medium embodiment of the BBTB with the cover of the disposal compartment cover removed.
Figure 17:
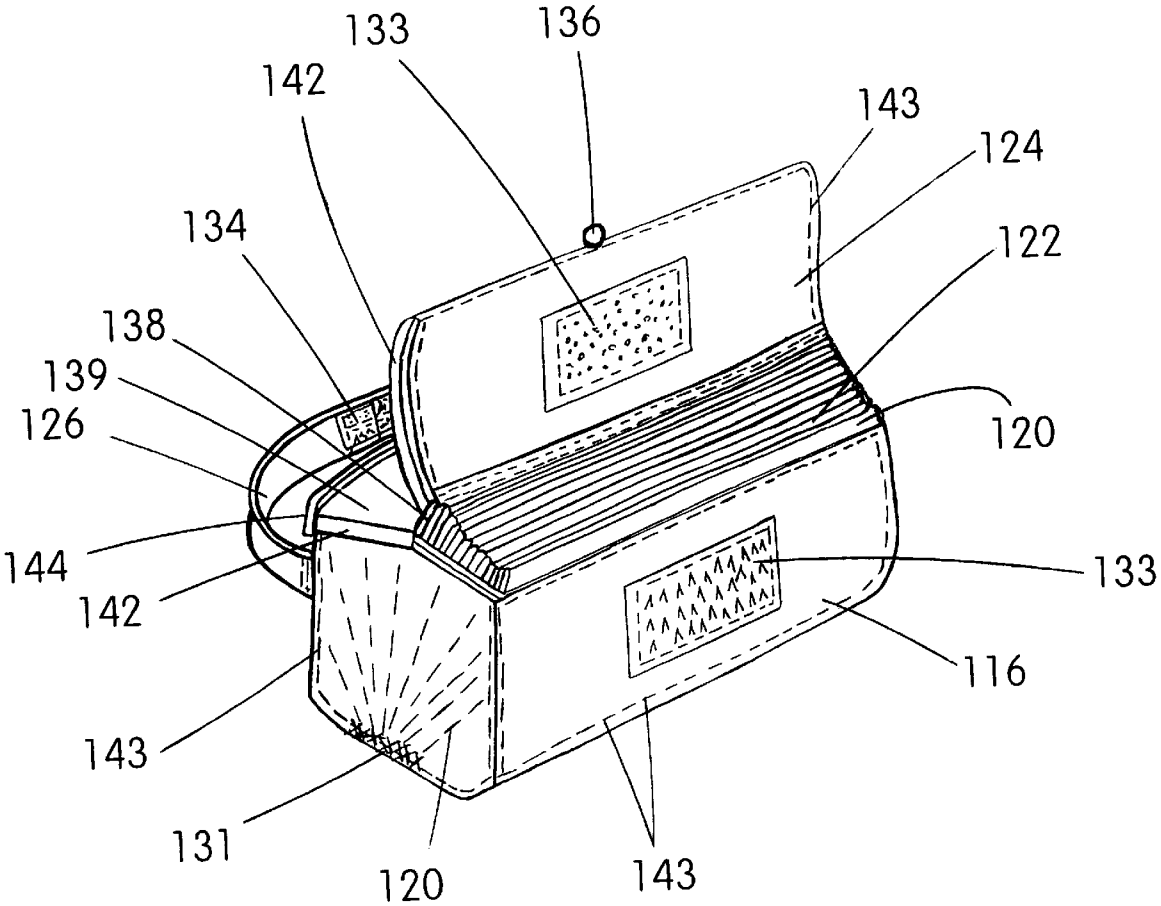
FIG. 17 is a perspective view of the large embodiment of the BBTB with the cover of the dispensing compartment open.
Figure 18:
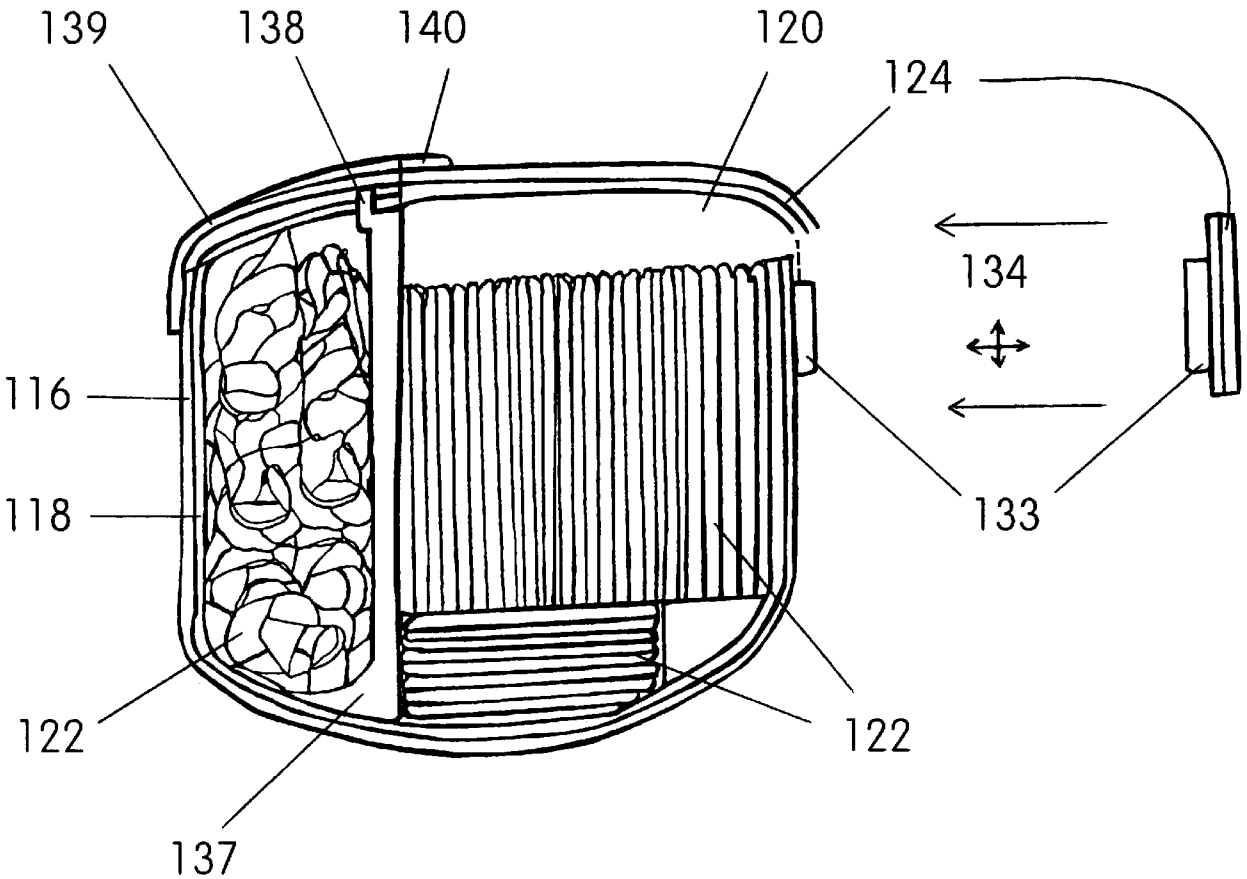
FIG. 18 is a sectional side view of the large embodiment of the BBTB.
Figure 19:
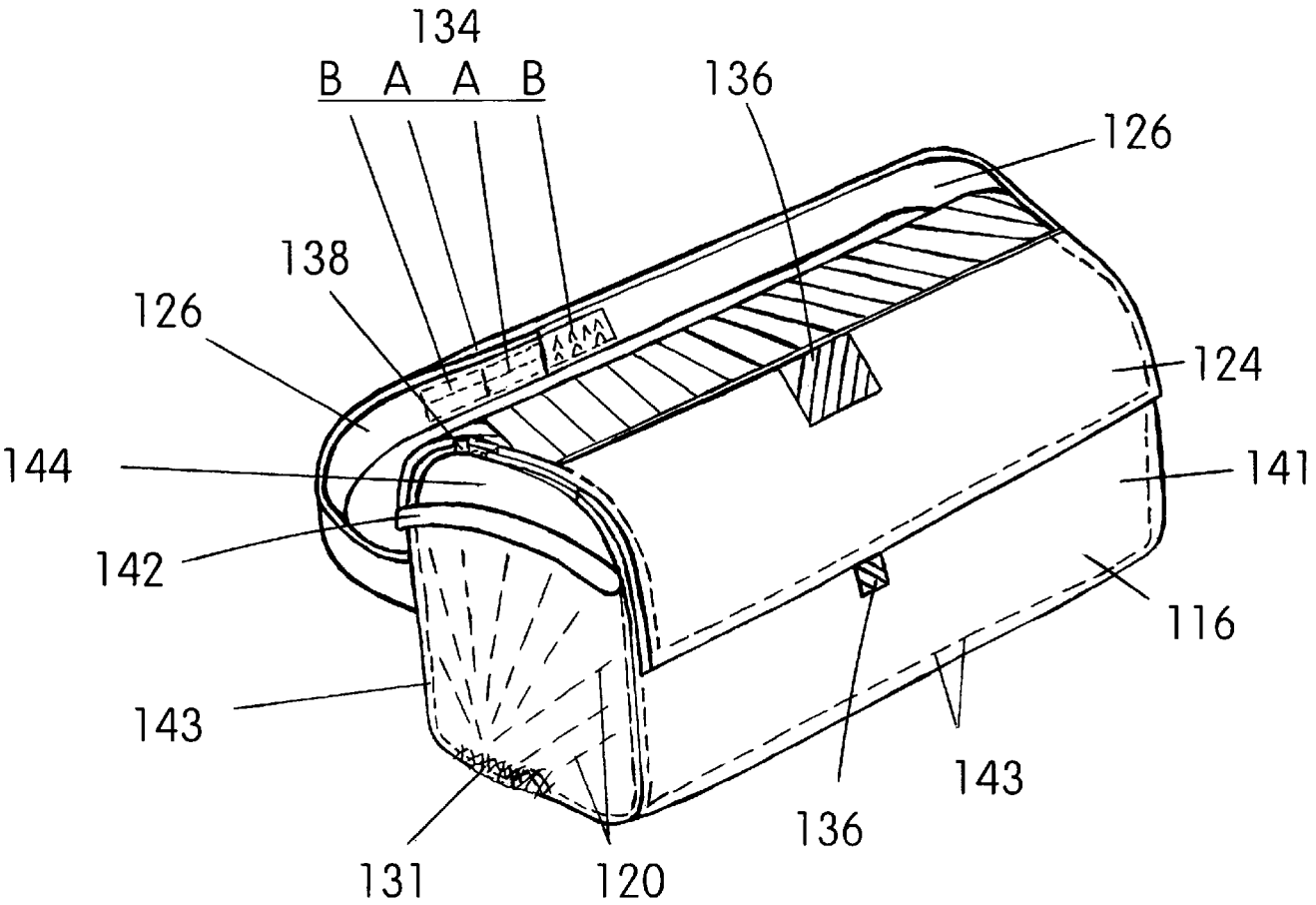
FIG. 19 is a perspective view of the large embodiment of the BBTB with all compartments closed.

Another functional embodiment (FIG. 9), configuration #4, is particularly intended for use as an around-the-waist, hands-free, BBTB for toddlers and young, slender children, the elderly and the like. However, this embodiment could additionally be used by persons of any age, in any context, that hands-free, on or off body, convenient access to antiseptic towelettes is required. As such, this configuration involves the use of only one of two available extension straps, thereby limiting the potential strap length to a range suitable for the above mentioned purposes. In use, the closure apparatus 146 of one of two extension straps 150 (FIG. 11) can be firmly connected 145 (FIG. 8) at one end, to the complementary apparatus strap 126 multi-purpose/multi-configuration closure apparatus 134. In use, this apparatus configuration provides for intermediate expansion of apparatus strap length by attaching only one of pair of extension strap 150 (FIG. 9) to the cooperative end hook and loop (or the like) closure configuration of only one permanent apparatus strap 126 (FIG. 12). As such, only one part of two-part quick-release buckle 152 is removably attached to the apparatus straps (FIG. 12). The second part of the quick-release buckle is engaged to the permanent apparatus strap configuration by passing the end "four-part closure configuration" 134 of the BBTB strap 126 (FIG. 12) through the remaining buckle component, and folding same over distal end of buckle for secure attachment of apparatus strap to that buckle component 153 (FIG. 12).

In use, an adult/medium around-the-waist, hands-free portable BBTB, configuration #5, requires the attachment of both adjustable extension strap 150 end closure apparatus 146 (FIG. 11) to complementary apparatus strap-end closure configurations 134. The pair of adjustable, removable extension straps 150 (FIG. 8) provides extension of total strap length up to approximately 48 inches (President Clinton's weekly radio address, March 1999 disclosed finding that 72% of Americans are overweight). Each strap is essentially doubled in length for extension of same. Strap coupler 151 (FIG. 8) automatically maintains selected strap locks and is manually adjusted for purposes of adding and reducing length of each strap is described below. Each adjustable extension strap has, at one end, the same style hook and loop (or the like) multi-configuration attachment 146 (FIG. 11) found at the end of each permanent apparatus strap 126 (FIG. 5). The configuration of the cooperative hook and loop (or the like) components at the end of each extension strap 146 complements the configuration at the end of each apparatus strap 126, creating a secure closure between the two 147 (FIG. 11) by securing all four cooperative components of the hook and loop (or the like) multi-configuration attachments.

A strap coupler 151 (FIG. 8) is used for manual release of extension strap to both adjust and secure strap length as required in each unique situation. Adjustable strap-set (pair) can accommodate children as well as adults of average to larger than average girth.

As such, the multi-purpose BBTB apparatus is intended for use as a portable, convenient means of dispensing antiseptic, pre-moistened towelettes in any of a multitude of locations. The purpose being to "break the chain of contagion" by way of facilitating frequent disinfecting of hands without drying or irritating the skin. In conjunction with the education and training included in the LifeWorks Hand Cleansing System, the accessibility afforded by the BBTB implements the realistic opportunity to carry out the content of this education.

The present invention has three most preferred embodiments. A small embodiment is configured for Pre-School, Child, or Elderly age groups and holds 15–25 towelettes with sturdily attached strap lengths appropriate for wearing or attachment to convenient objects and appropriate body parts. While specifically designed for these populations, this BBTB embodiment can be used by any person, of any age. Strap-ends have four-part cooperative hook and loop (or the like) material for secure and adjustable fastening around body part, object, etc.; apparatus strap ends can also be fastened securely to a pair of adjustable extension straps to secure apparatus around waist, to hand from shoulder, or other location on or off person. Quick release buckles along with strap coupler serve to both release and secure strap extensions at required lengths.

For purposes of hand cleansing behavior modification the size of the BBTB including straps and closure apparatus provide children with the capability ("responsibility/honor") of transporting BBTB for the protection of other family members, which can serve as a powerful positive reinforcer for disease prevention/contagion control, for children. Although the smallest BBTB is specifically designed to accommodate the needs of children, it can be used by persons of any age. In use it can be attached to a person, clothing, or object such as a purse, brief case, grocery cart, wheel chair, walker, bed rail, or to any convenient stationary object for effortless portability. The BBTB also provides materials for independent self-care with respect to infectious diseases. Autonomous self-care is reported to be a high health care priority as an inordinate proportion of the health care bill goes for care of the elderly.

The second most preferred embodiment is a medium size Adult/Multi-Age BBTB that is secured around the waist, other body part or any convenient object. It holds approximately 40–50 towelettes in a dispensing compartment. This amount can be doubled by using the disposal compartment for towelettes. The strap-ends have a four-part cooperative hook and loop (or the like) material for secure and adjustable fastening around body part, object, or the like. The apparatus strap ends can be fastened securely to a pair of adjustable extension straps to secure apparatus around waist, to hang from shoulder, or other location on or off the person. Quick release buckles along with strap coupler serve to both release and secure strap extensions at required lengths.

The medium size BBTB embodiment is specifically intended for, but its use is not limited to, the adolescent/adult population. However, all of the functional applications described for the small BBTB embodiment are also applicable to the medium size BBTB. The adult frame can more easily carry a larger BBTB than can small children. In use patents, for example, can access a sufficient number of towelettes to meet anticipated needs for a child (children), and/or self (selves) for: marketing, a day of errands and/or recreation, fast food stop(s), or at the work desk. Adults as well as children are constantly touching sources of contact transmission of pathogens. Children are particularly likely to do so. Contaminated hands will transmit pathogens to food, to eyes tat are rubbed, etc. The medium embodiment is intended to provide frequent opportunities to break the cycle of contagion by making frequent hand cleansing readily available, fast, easy, and efficient. The medium size BBTB approximates the familiar "fanny pack" in both size and shape and can be worn around the waist. The medium embodiment is functionally inter-changeable with the two other BBTB apparatus sizes with the exception of towelette capacity.

The Large BBTB embodiment holds approximately 150 toweletes. The large embodiment is intended for use in situations likely to require the availability of a larger number of antiseptic towelettes than accommodated by the small and medium-size BBTB's. In many 'out of home' situations it is particularly important that an antiseptic towelette be insulated from the affects of sunlight, moisture, heat, environmental contamination, whether in the car, at a little league game, or on the beach. The design of the Large most preferred BBTB embodiment is identical to Small and Medium Sizes except for its greater depth and related towelette capacity. The large embodiment, as well as the small and medium size embodiments, is a multi-purpose apparatus. It provides hands-free portability in that it can be worn around the waist, hung from either shoulder, or the like. However, it is specifically intended for placement on or about (including hanging from) a (temporarily) stationary location thereby conveniently providing a large supply of toweletes when necessary. As such, the functional applications of the large BBTB embodiment include, but are not limited to: use for more than one person in lengthy and/or high pathogen risk activities providing a sufficient number of towelettes for convenient use.

All three BBTB embodiments are of identical structure except for size and related volume containable. All apparatus configurations described hereinabove are applicable although not necessarily equally desirable, to all three most preferred embodiment sizes of the BusyBody Travel Buddy. The above embodiments can incorporate various designs so as to make them more appealing. A holographic optical illusion, for example, would be appealing to a broad population base. Given an agreement with a manufacturer, a popular children's character could appear of the apparatus.

I claim:

1. A hands-free portable pre-moistened antiseptic towelette dispenser system for providing users with near omnipresent proximal and virtually universally adaptable access to varying quantities of pre-moistened antiseptic towelettes that can be used for multiple antiseptic skin cleansing and other sanitary cleansing purposes by nearly anyone, any time, anywhere, for self and others, and including cleansing of inorganic surfaces having a potential for high concentrations of pathogens, prior to skin contact therewith, said dispenser system providing a means for controlling the primary mode of the spread of infectious disease by reducing direct and indirect contact transmission of infectious pathogens which occur primarily before eating by hand transmission via a fecal to oral route; said portable antiseptic towelette dispenser system not being intended to replace traditional hand washing means, but rather to provide a convenient and efficient alternative means of antisepsis when traditional hand washing means, including sink with running warm water, soap and paper towels and other hand drying means are either unavailable, or sufficiently inconvenient to a person so as to result in non-compliance with safe hand hygiene; with material components of said antiseptic towelette dispenser system further being designed to implement classical and operant conditioning strategies by providing adaptability and versatility in portability, function, and context of use, so as to provide multiple forms of adaptation to efficiently meet the requirements of busy, high-demand and fast-paced lives and which can be worn around the waist, on a wrist, an ankle, diagonally across the chest, and vertically over a shoulder in addition to attachment to items worn, carried by, and in close proximity to users; wherein during use of said system, classical and operant conditioning strategies function to change undesirable and unhealthy human hygiene habits of users into desirable and healthy hygiene habits, in terms of both frequency and effectiveness of hand decontamination; wherein new healthy hand cleansing habits are taught, elicited, facilitated, provoked, effortlessly and unconsciously learned, reinforced, and sustained by highly redundant, multi-faceted, multi-disciplinary, multi-dimensional, multi-modal and effortless conditioning of people in the use of said pre-moistened antiseptic towelette dispenser system, as a result of which users of said system develop sustained healthy, safe hand hygiene habits and wherein other antiseptic skin cleansing habits and sanitary object cleansing habits are also learned; so that users of said system are influenced to behave in ways that control and prevent the spread of infectious disease, said hands-free portable pre-moistened antiseptic towelette dispenser system comprising:

a plurality of towelettes which are in a pre-moistened and antiseptic condition prior to use, said towelettes being adapted for providing positively reinforcing, soothing, non-drying, and no-rinse cleansing of skin surfaces on hands and other body parts;

a sturdy, moisture-resistant bag made from durable materials and having a first compartment and a second compartment, said first compartment being configured and dimensioned to receive a quantity of said unused pre-moistened antiseptic towelettes in a stacked and folded configuration, said second compartment being configured and dimensioned to receive said towelettes after use, said bag also having an exterior front portion, opposing sides each with a rearward portion, a reflecting and washable outer surface, insulation means adapted for isolating contents in said first and second compartments from external environmental influences, said bag further having a sturdy elastic base for expansion and contraction of bag size according to fullness of said compartments which are refillable;

an insulated, moisture-proof divider separating said first and second compartments that is configured to prevent contamination of said unused pre-moistened antiseptic towelettes in said first compartment by any of said soiled towelettes placed within said second compartment;

a pair of straps, each of said straps being permanently connected at a proximal end to a different one of said rearward portions of said bag, each of said permanently connected straps having a distal end and multi-configuration hook-and-loop strap closure means of alternating hook and loop members permanently attached to said distal end, each said strap closure means on said distal end of one of said permanent straps being complementary to said strap closure means on said distal end of its paired permanent strap, said strap closure means also being adapted for secure removable locking connection between said distal ends of said permanent straps, as well as secure removable attachment of said two permanent straps around body parts and items transported by a user, mobile items in contact with floor and ground surfaces the movement of which is guided by users, and inanimate objects; whereby said permanent straps provide multiple means of hand-free portability, so that users of said dispenser system are enabled to select the means of hands-free transport for said system according to changing situational requirements of the user, thereby providing opportunities for frequent, repetitive use of said dispenser system and strengthening the classical Pavlovian conditioned associative bond between the proximal presence of said dispenser system and the use of said antiseptic towelette dispenser system for hand decontamination purposes; said permanent straps further operantly conditioning frequent use of said dispenser system by providing positively reinforcing convenience, ease and speed of use, immediate accessibility, and adaptability via multiple user-selected hands-free portability options, for user-friendly availability of antisepsis despite the context of usage;

each said strap closure means on said distal ends of said permanent straps also being adapted for secure removable locking connection of each of said permanent straps to itself through lateral folding substantially in half, the hook and loop members in each half of said strap closure means being complementary to those in the opposing half of said closure means for secure removable attachment of said permanent straps to belt loops and narrow clothing and accessory straps, and also for secure removable attachment to additional fastening mechanisms including two-part quick-release buckles, so as to provide hands-free portability for said towelette dispenser system by allowing secure removable attachment of said bag around items worn and transported by users, inanimate objects, and mobile items in contact with floor and ground surfaces the movement of which is guided by users; said multi-configuration hook-and-loop strap closure means thereby providing users with additional multiple hand-free opportunities to conveniently, frequently and redundantly access said pre-moistened antiseptic towelettes from said bag, thereby providing a method of classical Pavlovian conditioning in the use of said towelette dispenser system for antiseptic hand cleansing purposes and other sanitary cleansing purposes; and, further augmenting hands-free portability of said bag by consistently providing positive incentives for use of said bag by making said bag proximal, convenient, easily accessible, and an immediate source of said pre-moistened antiseptic towelettes that further operantly conditions use of said bag for contagion control purposes;

at least one extension strap being adjustable in length and configuration, each said extension strap having opposite ends and fastening means associated with each of said opposite ends, each said fastening means having separable opposing parts being adapted for quick attachment and disconnection from one another, with at least one of said fastening means comprising permanently attached multi-configuration hook and loop strap closure means with alternating hook and loop members and wherein said hook and loop members in each half of said strap closure means are complementary to those in the opposing half of said strap closure means, said fastening means also being adapted for lateral folding substantially in half for secure removable attachment of said extension straps to belt loops and narrow clothing and accessory straps, as well as secure, removable non-folded attachment of said extension strap ends to said distal ends of said permanent straps, and further wherein said fastening means is user selected from a group consisting of multi-configuration hook-and-loop strap closure means of alternating hook and loop members, strap-length-adjusting strap couplers, and two-part quick-release buckle mechanisms each having an anchoring end adapted for receipt of a strap having multi-configuration hook-and-loop strap closure means attached thereto so that said anchoring ends of said two-part quick release buckle mechanisms can be securely and removably attached to said opposite ends of each said adjustable extension strap, and also attached to said distal ends of each of said permanently connected straps, through lateral folding of said multi-configuration hook-and-loop strap closure means substantially in half, around one of said anchoring ends, and further through application of slight pressure to said closure means after being substantially folded in half so that said secure removable fastening means provides multiple user-selected options for hands-free portability of said bag further augmented by said adjustable extension straps, thereby providing users with repetitive, redundant, quick, and easy access to said pre-moistened antiseptic towelettes in said bag for breaking the cycle of contagion of infectious diseases through redundant effortless classical and operant conditioning irrespective of context and age limitation; wherein the resultant lessening of infectious disease incidence and contagion provide positive reinforcers for additional use of said bag for contagion control purposes in domestic, business, commercial, educational, health care, child care, food preparation and service, long term care, institutional, military, and government settings;

said first compartment in said towelette dispenser bag having a first selectively and easily openable cover , and also having a first part of at least one of said hook-and-loop closure mechanisms permanently attached thereto, and said first cover also having a first part of at least one two-part pressure clip closure mechanism permanently attached thereto, all of said multiple part closure mechanisms being configured for fast, easy, and secure removable attachment of said first cover to said towelette dispenser bag via complementary second parts of each said hook-and-loop closure mechanism and pressure clip permanently attached to said exterior front portion of said bag; wherein easy and secure removable attachment of said first cover provides a positive incentive for frequent use of said bag for contagion control purposes by preventing contamination, dehydration, and inadvertent loss of stored contents in said first compartment; thereby protecting the sanitary integrity and safety of said pre-moistened antiseptic towelettes; wherein such protection relieves users of worry and required protective measures to insure safety and sanitary integrity of unused ones of said towelettes stacked in said first compartment, thereby facilitating ease of using said towelette dispenser bag which positively reinforces and further promotes increased use of said towelette dispenser system for contagion control purposes via operant conditioning; wherein according to the Laws of Human Learning, Motivation, and Emotion, positive operant conditioning provided by said first easily opening cover further increases the probability of subsequent use of said towelette dispenser system for contagion control by the user, and simultaneously provides a means of strengthening the classically conditioned associative bond between the presence of and use of said bag for antiseptic hand cleansing and other contagion control purposes; said first easily openable cover further being configured for providing prompt one-handed access to said soothing and nourishing pre-moistened antiseptic towelettes which leave residual pleasant feelings on the skin, thereby conditioning positive anticipatory behavior in the user so as to reliably increase subsequent use of said towelette dispenser system, and also reliably strengthening a classically conditioned associative bond, in the user, between the proximal presence of said dispenser system and use of said system for skin cleansing purposes, said easily openable cover further strengthening both the classically conditioned associative bond and desired operantly conditioned response by being strategically designed for easy and safe use without negative reinforcers, and thereby avoiding anxiety in users due to complexity and uncertainty regarding correct and safe use of said bag; wherein any such negative emotional response to the use of said antiseptic towelette dispenser system resulting from complexity and uncertainty would negatively reinforce employment of said bag for contagion control purposes thereby predictably reducing the frequency of use of same; with any resulting decreased frequency of use tending to cause a further decrease in strength of classical associative conditioning use of said bag for contagion control purposes; wherein to the extent that said classical conditioned associative bond is extinguished in the user, unlearning of conditioned healthy contagion control behavior would lead to decreased frequency of use of said bag for contagion control purposes; and said second compartment in said towelette dispenser bag having a second selectively and easily openable cover with an interior surface and a first part of at least one of said hook-and-loop closure mechanisms permanently attached to said interior surface, and said second cover also having a first part of at least one two-part pressure clip closure mechanism permanently also attached to said interior surface, all of said multiple part closure mechanisms being configured for secure removable attachment of said second cover to said bag, wherein, the second parts of each said closure mechanism used with said second cover are attached permanently to said outer surface of said bag wherein said multiple part closure mechanisms are configured for secure removable attachment of said second cover to said outer surface of said bag, in order to minimize environmental contamination and inadvertent loss of stored contents in said second compartment;

wherein opening and closing said covers of said first and second compartments are identical actions, thereby providing users with one of a multiplicity of repetitive and redundant actions, which induce in each user effortless learning, via classical conditioning that establishes an unconscious association of antiseptic hand cleansing and other sanitary cleansing functions, with the presence of said towelette dispenser system, and contributes to the multiple conditioning strategies integral to material structural components of said bag thereby eliciting increased frequency and effectiveness of hand cleansing behavior on behalf of contagion control of infectious diseases;

further wherein opening and closing said covers allows users to employ only one hand to lift away said covers with the back of a user's hand and leave all five digits on that hand free for dispensing use; single-handed securing, dispensing, and discarding of a desired number of said towelettes; and removal of the user's hand from underneath said first cover to allow said first parts of each said pressure clip attached to said first cover to again make contact with its paired second part attached to said bag, and also allow said first part of each said hook and loop closure mechanism attached to said first cover to again make contact with its paired second part attached to said bag, and thereafter securely re-attaching said closure means on said interior surface of said covers to said complementary and cooperating closure means on said outer surface of said bag with slight pressure from the back of only one hand, said towelette dispenser system thereby safely and conveniently leaving the other hand free to perform non-towelette dispensing functions;

further wherein said two-part quick-release buckles, said strap couplers, and said hook and loop strap closure means provide rapid attachment and disconnection of said extension straps and thereby assist in providing users with an easily learned, fast and convenient means of hand and other antisepsis, of which the ease, speed, and convenience provides positive reinforcement of the use of said towelette dispenser system, via positive operant conditioning that reliably increases the probability of repetition of healthy user hygiene habits; and further wherein when users perform identical steps of opening, dispensing, depositing, and closing said first and second compartment covers, which in addition to the ease, speed, and convenience of antiseptic hand cleansing provided, elicit repetitive and redundant classical and operant conditioning for desirable healthy hand hygiene and other sanitary cleansing behavior by the user, behavior modification in the form of increased frequency of use of said bag for hand decontamination and other sanitary cleansing purposes is provoked on behalf of contagion control of infectious diseases.

2. The hands-free portable antiseptic towelette dispenser system of claim 1 wherein said bag is configured in three sizes, with user selection being determined according to anticipated duration of use and population size to be serviced; the first of said three sizes having respective length, width, and height dimensions of approximately two-and-one-half inches, two-and-three-fourths inches, and two inches to contain approximately fifteen to twenty of said pre-moistened antiseptic towelettes; the second of said three sizes having respective length, width, and height dimensions of approximately eight inches, three to four inches, and four inches to contain approximately forty to fifty of said pre-moistened antiseptic towelettes; and the third of said three sizes having respective length, width, and height dimensions of approximately eight-and-one-half inches, five inches, and six inches to contain approximately one hundred fifty of said pre-moistened antiseptic towelettes to provide antiseptic hand cleansing means where a sink with warm running water, soap and paper towels necessary for thorough hand decontamination are absent, unsanitary, or inconvenient to access; wherein said first bag is configured primarily for use by preschool and elementary school aged children, the elderly, as well as infirmed and disabled persons, wherein the proximal presence of said towelette dispenser bag provides a means of independent, preventative self health care even when user mobility is restricted; wherein said second bag is configured primarily for adults in general, in substantially all vocational, domestic, and recreational contexts for sanitary cleansing purposes relating to self and others; and wherein said third bag is configured for use by multiple persons during group outings day travel, recreational travel, and recreational activities; whereby as a result of variable bag size being selected according to anticipated need users are provided with additional, redundant opportunities to strengthen unconscious, easy, and effortless learned association between presence of said bag and antiseptic hand and other sanitary cleansing functions; and further whereby variable bag size allows for age, context, and multipurpose adaptability to further provide opportunities for a high level of repetition, further multi-contextual generalization of learning, and strengthened user-familiarity with bag presence and procedures for using said bag so as to provide a steep gradient of cumulative learning via positive operant conditioning; thereby frequency of use of said bag is increased, the stimulus-response associative bond strengthens with such additional use, and such strengthening causes the frequency of use of said bag to further increase.

3. The hands-free portable antiseptic towelette dispenser system of claim 1 wherein said pre-moistened antiseptic towelettes further comprise moisturizing and skin-nourishing substances which are adapted to leave residual pleasant feelings on the skin, thereby providing a predictable source of positive reinforcement, including the conditioning of positive anticipatory behavior in users so as to reliably increase their subsequent use of said towelette dispenser system, and further thereby reliably strengthening the classically conditioned associative bond in the user between the proximal presence of said dispenser system and the use of said system for skin cleansing purposes; and whereby said moisturizing and skin-nourishing substances provide multi-disciplinary and multi-dimensional behavior modification by incorporating knowledge from several scientific disciplines to address the unsolved global problem of infectious disease contagion control.

4. The hands-free portable antiseptic towelette dispenser system of claim 1 wherein said opposing halves of said multi-configuration hook-and-loop strap closure means are dimensioned and configured to provide secure non-folded connection to one another within a lengthwise adjustability tolerance between approximately one-half inch and one inch.

5. The hands-free portable antiseptic towelette dispenser system of claim 1 wherein said extension straps are water-resistant and made from woven material.

6. The hands-free portable antiseptic towelette dispenser system of claim 1 wherein said bag is made from flexible fabric adapted to allow said bag to substantially conform to the body parts and items worn by a user to which said bag becomes attached during use for comfortable proximal positioning of said bag relative to the user.

7. The hands-free portable antiseptic towelette dispenser system of claim 1 wherein each of said multi-configuration hook-and-loop strap closure means comprises a four part configuration of cooperative hook and loop material.

8. The hands-free portable antiseptic towelette dispenser system of claim 1 wherein said strap couplers are configured and adapted for fixing user selected extension strap length, and are selected from a group consisting of single ring couplers, double ring couplers, and rectangular couplers.

9. The hands-free portable antiseptic towelette dispenser system of claim 1 wherein said bag is dimensioned to contain approximately fifteen to twenty of said pre-moistened antiseptic towelettes and adapted to provide hands-free portability primarily to children and the elderly solely by secure but removable attachment of said distal ends of said permanent straps to one another around a wrist.

10. The hands-free portable antiseptic towelette dispenser system of claim 1 wherein said bag is dimensioned to contain approximately fifteen to twenty of said pre-moistened antiseptic towelettes and adapted to provide hands-free portability primarily to children, the elderly, and the infirmed by secure but removable end-to-end attachment of said permanent straps and one of said extension straps, around the wrist of the user, inanimate objects, and items being transported by a user.

11. The hands-free portable antiseptic towelette dispenser system of claim 1 wherein said bag is dimensioned to contain approximately forty to fifty of said pre-moistened antiseptic towelettes and adapted to provide hands-free portability primarily to adults by secure but removable end-to-end attachment of said permanent straps and two of said extension straps around waists, diagonally across the chest, and vertically from a shoulder for a maximum strap length adjustability of approximately forty-eight inches.

12. The hands-free portable antiseptic towelette dispenser system of claim 1 wherein said bag is dimensioned to contain a maximum of approximately fifty of said pre-moistened antiseptic towelettes and adapted to provide hands-free portability primarily to adults for contagion control purposes relating to self and others; and wherein the items to which said bag can be removably attached for hands-free portability are selected from a group consisting of book bags, purses, brief cases, sport bags, beach paraphernalia, lunch boxes, backpacks, desks, lockers, bed rails, bicycles, walkers, wheel chairs, grocery carts, coat racks, belt loops, and diaper bags.

13. The hands-free portable antiseptic towelette dispenser system of claim 1 wherein said bag is dimensioned to contain a maximum of approximately one hundred fifty of said pre-moistened antiseptic towelettes and adapted to provide hands-free portability to multiple persons primarily during travel and activities outside the home by varying combinations of end-to-end attachment of said permanent straps and said extension straps, and by use of said fastening means, for secure but removable attachment of said bag to items worn and transported by users, inanimate objects, and mobile items in contact with floor and ground surfaces the movement of which is guided by users.

14. The hands-free portable antiseptic towelette dispenser system of claim 1 wherein said permanent straps are secured to said rearward portion of said bag by multiple sturdy rows of stitching.

15. The hands-free portable antiseptic towelette dispenser system of claim 1 wherein said multi-configuration hook-and-loop strap closure means are secured by multiple sturdy rows of stitching.

16. The hands-free portable antiseptic towelette dispenser system of claim 1 further comprising at least one educational message relating to infectious disease contagion control, each said educational message being adapted for providing the virtually omnipresent, on-going education essential for sustained behavior modification.

17. The hands-free portable antiseptic towelette dispenser system of claim 16 wherein said educational messages are selected from a group consisting of textual messages, illustrations, combined imagery and text, holographic optical illusions, high appeal characters, and high appeal visual imagery.

18. The hands-free portable antiseptic towelette dispenser system of claim 1 wherein said pre-moistened towelettes further comprise multi-antimicrobial substances and means for mechanical friction adapted to provide multi-purpose antiseptic cleansing functions for infectious disease control as well as prevention, wherein prevention is achieved by said multi-antimicrobial substances and said mechanical friction means applied by the user during use of said towelettes being able to remove dirt and microbial waste from the hands, other areas of the skin on self and others in diapering and toileting contexts, said outer surface of said bag, and inorganic surfaces having a high probability of a high pathogen load which would be a source of indirect contact transmission of pathogens if not sanitarily cleansed prior to skin contact therewith, as well as being used as a shield for hands to avoid hand contact with inorganic surfaces having a high probability of a high pathogen load, and whereby multi-purpose use of said system adds to user familiarity with said system which increases the rate at which behavior modification occurs and expands adaptation of said system to new contexts, said multi-antimicrobial substances and means for mechanical friction also providing multi-faceted behavior modification by teaching an alternative way to wash, reducing opportunities for contagion, creating a paradigm shift to prevention, increasing social awareness, teaching people the impact of their own behavior, and forcing people to take responsibility for their own good health and good hygiene habits.

19. The system of claim 18 wherein said multi-antimicrobial substances further comprise emollients, vitamins, and botanicals adapted to provide skin-enhancing effects selected from a group consisting of moisturizing skin, prevent drying of skin, aid in the health and integrity of skin, provide prophylactic dermal tissue nourishment, and leaving residual pleasant feelings on the skin, all said skin-enhancing effects being positive reinforcers for continued use of said towelettes; said emollients, vitamins, and botanicals also being adapted for providing multi-modal involvement of the human senses, whereby when more senses become involved, learning and sustained behavior modification are accelerated.

20. The system of claim 1 wherein said insulation means comprises radiant barrier insulation adapted to provide protection of contents in said first and second compartments from light, ambient humidity fluctuations, and changes in ambient temperature, said radiant barrier insulation comprising a thin mylar center sandwiched between thin aluminum sheets adapted for protecting the sanitary integrity and aesthetic appeal of said unused towelettes housed in said first compartment which would otherwise become dried out over time; thereby avoiding sources of negative reinforcement during repeated use of said system that would reliably result in the diminished strength of operant conditioning for the use of said dispenser system as a means of preventing the spread of infectious diseases.

21. The system of claim 1 wherein said divider comprises an upper edge, said first and said second selectively and easily openable covers are attached said upper edge, and said second cover has a co-extensive piece overlapping said first cover.

22. A method of using a dispenser system for pre-moistened antiseptic towelettes that provides near omnipresent proximal and virtually universally adaptable access to varying quantities of pre-moistened antiseptic towelettes usable for multiple antiseptic skin cleansing and other sanitary cleansing purposes by nearly anyone, any time, and anywhere, for self and others, including cleansing of inorganic surfaces having a potential for high concentrations of pathogens, prior to skin contact therewith, for control and prevention of the spread of infectious diseases by reducing the primary means for spread of infectious diseases, which is direct and indirect contact transmission of infectious pathogens by hand transmission via a fecal to oral route; said method not being intended to replace traditional hand washing means, but rather to provide a convenient and efficient alternative means of antisepsis when traditional hand washing means, including sink with running warm water, soap and paper towels and other hand drying means necessary for thorough hand decontamination are either absent, unsanitary, or sufficiently inconvenient to a person so as to result in non-compliance with safe hand hygiene procedures; with steps of said method being determined according to classical and operant conditioning strategies to adapt to busy, high-demand and fast-paced lives; wherein classical and operant conditioning strategies function to influence users to behave in ways that change undesirable and unhealthy human hygiene habits into desirable and healthy hygiene habits, in terms of both frequency and effectiveness of hand decontamination; wherein new healthy hand cleansing habits are taught, elicited, facilitated, provoked, effortlessly and unconsciously learned, reinforced, and sustained by highly redundant, multi-faceted, multi-dimensional and effortless conditioning of people as a result of which users develop sustained healthy, safe hand hygiene habits and wherein other antiseptic skin cleansing habits and sanitary object cleansing habits are also learned that control and prevent both direct and indirect contact transmission of infectious diseases; and whereby hand hygiene habits and other cleansing behavior in users which contribute to the spread of infectious diseases become unlearned and extinguished, said method comprising the steps of:

providing a self-contained hands-free, portable pre-moistened antiseptic towelette dispenser system having material components integral to classical and operant behavioral conditioning strategies, said material components of said towelette dispenser system comprising a moisture-resistant bag with a first refillable compartment adapted to receive unused pre-moistened antiseptic towelettes in a folded and stacked configuration and a second refillable compartment adapted to receive said towelettes after use, an insulated moisture-proof divider separating said first and second compartments that is adapted to prevent cross-contamination between said first and second compartments, a reflecting washable outer surface, insulation adapted to protect contents in said first and second compartments from external environmental influences, a sturdy elastic base for expansion and contraction of bag size according to fullness of said compartments, and two permanent straps connected rearwardly to opposing sides of said bag each having a distal end with a multi-configuration hook-and-loop strap closure means of alternating hook and loop members permanently attached to said distal end, said strap closure means on said distal ends being complementary to one another, said strap closure means also being adapted for secure removable locking non-folded connection between said distal ends, as well as secure removable locking connection of each of said permanent straps to itself through lateral folding of said multi-configuration hook-and-loop strap closure means substantially in half, said hook and loop members in each half of said strap closure means being complementary to those in the opposing half of said closure means for secure removable attachment of said permanent straps to additional fastening mechanisms including two-part quick-release buckles; also providing a plurality of support objects;

providing a plurality of folded and stacked unused pre-moistened antiseptic towelettes adapted for soothing non-drying, and no-rinse cleansing of skin surfaces on hands and other body parts, a plurality of elongated extension straps each being adjustable in size and configuration and having fastening means associated with each of its opposite ends, at least one of said fastening means including permanently attached multi-configuration hook and loop strap closure means and wherein hook and loop members in each half of said strap closure means are complementary to those in the opposing half of said closure means, as well as complementary to said strap closure means attached to each of said permanent straps for secure removable attachment therebetween, a plurality of strap couplers each adapted for removably fixing said extension straps at different user-selected lengths for lengthwise adjustability, and a plurality of quick release buckles each having an anchoring end adapted for receipt of a strap having multi-configuration hook-and-loop strap closure means attached thereto wherein said anchoring ends can be securely and removably attached to said opposite ends of each said extension strap and said distal ends of said permanently connected straps through lateral folding of said multi-configuration hook-and-loop strap closure means substantially in half around one of said anchoring ends, followed by application of slight pressure to said closure means;

providing a first selectively and easily openable cover for said first compartment, said first cover having a first part of at least one hook-and-loop closure mechanism and a first part of at least one two-part pressure clip closure mechanism permanently attached thereto, the second parts of each said hook-and-loop and two-part pressure clip closure mechanism being permanently attached to said exterior front portion of said bag and adapted for secure, easily openable positioning of said first cover over said first compartment to prevent contamination, dehydration, and accidental loss of stored contents in said first compartment; and further providing a second selectively and easily openable cover for said second compartment, said second cover having a first part of at least one hook-and-loop closure mechanism and a first part of at least one two-part pressure clip closure mechanism permanently attached thereto, the second parts of each said hook-and-loop and said two-part pressure clip closure mechanisms being permanently attached to said bag for secure removable positioning of said second cover over said second compartment and adapted for prevention of environmental contamination and accidental loss of stored contents in said second compartment;

using sanitary procedure to place a quantity of said unused stacked and folded pre-moistened antiseptic towelettes within said first compartment of said bag;

closing said first cover securely against said outer surface of said bag so as to prevent contamination, dehydration, and inadvertent loss of said unused towelettes;

selecting one of said system support objects from a group consisting of body parts, items worn by a user, items transported by a user, mobile items in contact with floor and ground surfaces the movement of which is guided by users, and inanimate objects employing selected ones of said permanent straps, said extension straps, said strap couplers, and said buckles to provide end-to-end strap connections which create ample and sufficient strap length for connection of said system to said selected support object;

using said end-to-end connected straps and buckles to securely and removably anchor said bag to said selected support object for hands-free portability and use of said bag for contagion control purposes;

lifting away said first cover from said outside surface of said bag with one hand so that said first cover rests open on the back of a user's hand to leave all five digits on that hand free for securing and dispensing user-selected quantities of said towelettes;

singled-handed securing and dispensing of a user-selected number of towelettes from said first compartment wherein the user's second hand remains free to perform other functions;

once said step of securing and dispensing is complete, removing said hand from underneath said first cover to allow gravity-assisted movement of said first pails of each said pressure clip attached to said first cover toward its paired second part attached to said bag, and also allow gravity-assisted movement of said first part of each said hook and loop closure mechanism attached to said first cover toward its paired second part attached to said bag;

applying slight pressure with the back of a hand to securely close said first cover against said bag to secure contact between paired parts of each said pressure clip and each said hook and loop closure mechanism to removably seal said first compartment; and optionally repeating at least one additional time said steps of lifting, securing, and removing with respect to said first and second covers to gain additional access to said first and said second compartments and subsequently repeating said step of applying slight pressure with the back of a hand to securely close said first and second covers against said washable outside surface of said bag to seal said first and second compartments and prevent contamination of said unused stacked towelettes in said first compartment by items housed in said second compartment so that users are able to experience convenient, virtually effortless and immediate access, substantially at any time and anywhere, to the number of antiseptic towelettes determined to be necessary for hand, body, and other antiseptic contagion control purposes related to the user's needs and the needs of others;

wherein said steps of providing and using said soothing and non-drying pre-moistened antiseptic towelettes for skin cleansing purposes provides a predictable source of positive reinforcement, including conditioning of positive anticipatory behavior in users so as to reliably increase their subsequent use of said towelette dispenser system, and further reliably strengthening a classically conditioned associative bond in the user between the proximal presence of said towelette dispenser system and use of said system that further promotes increased frequency of use of said system for skin cleansing purposes;

wherein said steps of providing and using said permanent straps and said multi-configuration hook-and-loop strap closure means provide multiple options for hands-free portability, wherein the strategic versatility provided having multiple options for hand-free portability allows users to easily and quickly adapt positioning of said hands-free towelette dispenser system according to changing situational requirements, and further allows users to select system size according to different user-anticipated quantitative requirement; thereby providing multiple opportunities in a variety of contexts for frequent and user-friendly access to said pre-moistened antiseptic towelettes for hygienic contagion control purposes; thereby operantly conditioning use of said system by providing users with repeated experiences of positively reinforcing convenience, efficiency, and adaptability for immediate access to multiple pre-moistened antiseptic towelettes for infectious disease contagion control purposes despite the context of usage; and, further, simultaneously and repetitively eliciting effortless classical Pavlovian conditioning of the use of said system for antiseptic hand cleansing purposes;

wherein said steps of providing and using said extension straps for augmenting hands-free portability of said system provides users with a means for breaking the cycle of contagion of infectious diseases through repetitive, redundant, quick, and easy access to said pre-moistened antiseptic towelettes wherein the user is exposed to multiple and varied opportunities for efficient use of said dispenser system, wherein users experience redundant effortless classical and operant conditioning in the use of said system for contagion control purposes, in virtually any context, and virtually independent of age limitations; wherein the resulting lessening of infectious disease incidence and prevention of contagion as a result of use of said system provide positive reinforcers which promote additional use of said system and further promote development of sustained, safe, healthy hand hygiene habits on behalf of contagion control of infectious diseases for self and others in any domestic, business, commercial, educational, health care, child care, food preparation and service, long term care, military, institutional and government settings;

wherein structurally-induced protection of stored contents in said bag relieves users of worry and user-initiated protective measures to insure safety and sanitary integrity of said unused pre-moistened antiseptic towelettes stacked in said first compartment, thereby facilitating both logistic and psychological ease of using said bag which further positively reinforces additional employment of said bag for contagion control purposes and further promotes sustained increased use of said towelette dispenser system for self and others for infectious disease contagion control purposes via operant conditioning; while at the same time said system prevents negatively reinforcing worry regarding safety and complexity of use of said system, and thereby avoids further negatively reinforcing behavioral and emotional experiences in the course of using said dispenser system, which would otherwise cause reduced frequency of use thereof; with any resulting decreased frequency of use tending to cause a further eroding of the strength of any previously developed classical associative conditioning use of said bag for contagion control purposes; wherein to the extent that classical conditioning is extinguished in the user, unlearning of conditioned healthy contagion control behavior would lead to decreased frequency of use of said bag for healthy and safe hand hygiene, as well as other infectious disease contagion control purposes;

wherein said steps of lifting away and closing said covers of said first and second compartments are identical actions, thereby providing the user with two of many repetitive and redundant actions during use of said system, which induce in the user repetitive experiences of effortless learning, via classical conditioning, wherein an unconscious associative bond of antiseptic hand cleansing and other sanitary cleansing functions with the presence and means of use of said towellette dispenser system is formed and strengthened so that said cleansing functions become habitual behavior, thereby further contributing to the multiple conditioning strategies integral to material structural components of said antiseptic cleansing system, all of which facilitate and elicit increased frequency and effectiveness of hand de-contamination on behalf of breaking the cycle of contact transmission of infectious diseases; said multiple, over-lapping, repetitive and redundant operant and classical conditioning strategies integral to the material components of said dispenser system, including said steps of lifting away and closing said covers of said first and second compartments, further contributing to over-learning, by the user, of desirable conditioned behaviors which serve to strengthen the tenacity of learned healthy hygiene habits, and thereby further providing users with enhanced resistance to diminution of learned behavior by confrontation with inevitable negatively reinforcing factors;

further wherein said steps of lifting away and closing said covers allow users to employ only one hand to open, dispense, and discard towelettes, and securely re-attach closure means on said interior surface of said covers to complementary and cooperating closure means on said exterior front portion of said bag with the use of only one hand and thereby conveniently leaving the other hand free to perform additional functions for self and others;

further wherein users are provided with an easily learned, fast and convenient means of hand and other antisepsis, of which the ease, speed, and convenience provides positive reinforcement reliably increasing the probability of sustained repetition of healthy user hygiene habits;

and further wherein when users perform the identical steps of lifting away of said first and second covers of said first and second compartments, dispensing of towelettes, and closing of said first and second covers, in addition to the ease, speed, and convenience of antiseptic hand cleansing provided, repetitive and redundant classical and operant conditioning is elicited for desirable healthy hand hygiene and other sanitary cleansing behavior by the user; thereby, provoking increased frequency of use of said system for hand decontamination and other sanitary cleansing purposes, on behalf of contagion control of infectious diseases.

23. The method of claim 18 wherein said step of providing said bag further comprises the step of providing a bag selected from a group consisting of a small bag having respective length, width, and height dimensions of approximately two-and-one-half inches, two-and-three-fourths inches, and two inches and which is adapted to contain approximately fifteen to twenty folded and stacked pre-moistened antiseptic towelettes; a medium bag having respective length, width, and height dimensions of approximately eight inches, three to four inches, and four inches and which is adapted to contain approximately forty to fifty folded and stacked pre-moistened antiseptic towelettes; and a large bag having respective length, width, and height dimensions of approximately eight-and-one-half inches, five inches, and six inches and which is adapted to contain approximately one hundred fifty folded and stacked pre-moistened antiseptic towelettes; and further comprising a step of selecting said bag according to a number of towelettes anticipated to most conveniently meet user needs; wherein said step of selecting said bag according to size provides users with multiple, redundant opportunities to strengthen unconscious, easy, and effortless learned association between presence of said bag and antiseptic hand and other sanitary cleansing functions; further said step of selecting said bag according to size allows for age, context, and multi-purpose adaptability to further provide opportunities for a high level of repetition, further adaptability, and user familiarity with bag presence and said method of bag use so as to provide a steep gradient of cumulative learning via positive operant conditioning; thereby frequency of use of said bag is increased, the stimulus-response associative bond strengthens with such additional use, and such strengthening causes the frequency of use of said bag to further increase; whereby both a result and cause of increased frequency of use of antiseptic hand cleansing via said antiseptic towelettes, in users will be positively reinforced.

24. The method of claim 22, wherein each of said strap couplers is selected from a group consisting of single ring couplers, double ring couplers, and rectangular couplers, and where said step of employing said strap couplers further comprises using each said strap coupler to anchor a different one of said opposite ends of said extension straps in a strap configuration and orientation that provides lengthwise adjustability of said extension strap; wherein said lengthwise adjustability allows users to have multiple opportunities for adapting hand-free portability of said cleansing system to unique, and changing, personal and situational requirements confronting users of said cleansing system; said lengthwise adjustability thereby also providing another of the multiple integral dispenser system components which create multiple user opportunities for versatile, practical and efficient hands-free portability and use of said bag for contagion control purposes, wherein users are enabled to experience, both quantitatively and qualitatively, greater instances of learned association between bag presence and use of said bag for self-protection as well as the protection of others from the spread of increasingly dangerous, multi-drug resistant infectious diseases, thereby strengthening the associative bond and contributing to modification of the user's hand cleansing and other sanitary habits in a variety of contexts, wherein positive behavior modification becomes sustained.

25. The method of claim 22 wherein said bag further comprises at least one message selected from a group consisting of messages adapted for on-going education of users regarding the importance of sustaining healthy hand decontamination prior to eating and other healthy hygiene habits in order to protect the user and others from the spread of infectious diseases; messages adapted for on-going education of users regarding the means by which healthy hygiene habits can be sustained; messages adapted for on-going education of users regarding the advantages of prevention of infectious diseases over reliance upon antibiotics; educational messages having written text; educational messages having high-interest visual imagery; and educational messages having high-interest age-targeted visual imagery; whereby repeated exposure of users and others to said educational messages positively reinforces behavioral changes in favor of healthy hygiene habits through encouragement of users as to health advantages of healthy hygiene habits and also through instilling fear in users as to dangers of unhealthy hygiene habits whereby through habitual use of preventative behavior conditioned by said messages the spread of infectious disease is shifted from contagion control to prevention.

26. The method of claim 22 wherein said bag is dimensioned to contain approximately fifteen to twenty pre-moistened antiseptic towelettes and adapted to provide hands-free portability and autonomous preventative self-health care primarily to children and the elderly solely by secure but removable attachment of said distal ends of said permanent straps to one another for removable attachment around a wrist, thereby positively reinforcing feelings of control.

27. The method of claim 22 wherein said bag is dimensioned to contain approximately fifteen to twenty pre-moistened antiseptic towelettes and adapted to provide hands-free portability and autonomous preventative self-health care primarily to children, the elderly, and the infirmed by secure but removable attachment of said distal ends of said permanent straps and one of said extension straps to one another for removable attachment around those of said support objects selected from a group consisting of wrists, waists, inanimate objects, and items being transported by a user, thereby positively reinforcing feelings of control.

28. The method of claim 22 wherein said bag is dimensioned to contain approximately fifteen to twenty pre-moistened antiseptic towelettes and adapted to provide hands-free portability primarily to children, the elderly, and the infirmed by secure but removable end-to-end attachment of said permanent straps and one of said extension straps for use around those of said support objects selected from a group consisting of wrists, waists, inanimate objects, and items being transported by a user, for autonomous self-help and feeling of control.

29. The method of claim 22 wherein said said bag is dimensioned to contain approximately forty to fifty pre-moistened antiseptic towelettes and adapted to provide hands-free portability primarily to adults by secure but removable end-to-end attachment of said permanent straps and two of said extension straps around waists, diagonally across the chest, and vertically from a shoulder for a maximum strap length adjustability of approximately forty-eight inches.

30. The method of claim 22 wherein said bag is dimensioned to contain a maximum of approximately twenty pre-moistened antiseptic towelettes and adapted to provide hands-free portability primarily by children and adults by lateral folding substantially in half of, and application of slight pressure after folding to, each of said multi-configuration hook-and-loop strap closure means on said distal ends of said permanent straps around those of said support objects selected from a group consisting of belt loops and clothing straps.

31. The method of claim 22 wherein said bag is dimensioned to contain a maximum of approximately one hundred fifty pre-moistened antiseptic towelettes and adapted to provide hands-free use to multiple persons primarily during travel and activities outside the home by varying combinations of end-to-end attachment of said permanent straps and said extension straps, and by use of said fastening means, for secure but removable attachment of said bag to those of said support objects selected from a group consisting of items worn and transported by users, inanimate objects, and mobile items in contact with floor and ground surfaces the movement of which is guided by users.

32. The method of claim 22 further comprising a step of laterally folding said hook and loop strap closure means substantially in half around those of said support objects selected from a group consisting of belt loops, narrow clothing straps, and narrow accessory straps, wherein said steps of using said end-to-end connected straps and buckles to securely and removably anchor said bag to said selected support objects for hands-free portability and use of said bag for proximal, convenient, and virtually ever-present positioning of said bag near to a user provides the user with repetitive associations of said bag to antiseptic hand cleansing that influence and condition the user to increase frequency of antiseptic hand cleansing behavior on behalf of infectious contagion control purposes, and wherein each of said repeated steps of lifting, securing, and removing with respect to said first and second covers comprises a classical conditioning event with redundant events serving to strengthen and maintain conditioned learning for reduced spread of infectious diseases.

33. The method of claim 22 wherein said insulation comprises radiant barrier insulation adapted to protect contents in said first and second compartments from light, ambient humidity fluctuations, and changes in ambient temperature, and wherein said steps of providing said insulated moisture-proof divider, said reflecting washable outer surface, said radiant barrier insulation, and said sturdy elastic base for expansion and contraction of bag size according to fullness of said compartments each assist in relieving a user of effort and inconvenience in maintaining antiseptic integrity of said unused pre-moistened antiseptic towelettes in said first compartment, and thereby encourage positively reinforcing repetitive use of said towelettes for contagion control purposes, said step of providing antiseptic cleansing means in the form of a familiar, user-friendly disposable towelette also encouraging positively reinforcing repetitive cleansing use of said towelettes.

34. The method of claim 22 wherein said towelettes are adapted to provide mechanical friction for removal of dirt and microbial waste from skin surfaces and said outer surface of said bag; and further wherein said towelettes comprise substances selected from a group consisting of emollients, vitamins, and botanicals, whereby said towelettes moisturize skin, preventing drying, aid in the health and integrity of skin, and provide prophylactic dermal tissue nourishment, all such skin enhancing functions being positive reinforcers for frequent and continued use of said towelettes.

35. A portable towelette dispenser apparatus comprising:

a bag having a reflecting and washable outer surface, two compartments, and an insulated divider between said two compartments, one of said compartments being configured and adapted for housing a plurality of unused, folded and stacked, pre-moistened antiseptic towelettes and maintaining antiseptic integrity of said towelettes;

a plurality of adjustable elongated straps, at least two of said straps being adapted for connection to said bag, said straps also being adapted for connection to one another in end-to-end relation;

at least one multiple-part fastening means associated with said straps and having a permanently attached multi-configuration hook-and-loop strap closure means capable of being folded laterally in half to form a first half and a second half, said strap closure means comprising alternating hook and loop members in said first half that are complementary to additional alternating hook and loop members in said second half so that when said first half and said second half are placed against one another all of said hook members are in a position opposed to a different one of said loop members for secure removable engagement therewith, said alternating hook and loop members in each said strap closure means also being complementary to those of said hook and loop members associated with other ones of said straps for secure removable non-folded engagement therewith; and said compartments each having a selectively and easily-openable flexible sealing cover means adapted for preventing environmental contamination and inadvertent loss of stored contents in said compartments, said cover means being adapted for single-handed upward separation away from said bag so as to rest in an opened position on the back of a user's hand thereby leaving all five digits on that hand free to easily secure and dispense a desired number of towelettes, and said cover means being further adapted for secure closing against said outer surface of said bag with an application of slight pressure using the back of a hand whereby convenient, immediate, and nearly omnipresent access to antiseptic towelettes is provided for infectious disease contagion control and prevention purposes and repeat use of said dispenser apparatus provides multiple, multi-model, redundant means of conditioning for teaching, influencing, provoking, unconsciously learning of, reinforcement, and sustained modification of hand cleansing behavior that reduces the incidence and spread of infectious diseases.

* * * * *